US006250381B1

(12) United States Patent
Nishishita

(10) Patent No.: US 6,250,381 B1
(45) Date of Patent: Jun. 26, 2001

(54) HEAT EXCHANGER

(75) Inventor: Kunihiko Nishishita, Konan (JP)

(73) Assignees: Zexel Corporation; Toyo Radiator Co., Ltd., both of Tokyo (JP)

( * ) Notice: Subject to any disclaimer, the term of this patent is extended or adjusted under 35 U.S.C. 154(b) by 0 days.

(21) Appl. No.: 09/530,416

(22) PCT Filed: Nov. 13, 1998

(86) PCT No.: PCT/JP98/05120

§ 371 Date: May 1, 2000

§ 102(e) Date: May 1, 2000

(87) PCT Pub. No.: WO99/26037

PCT Pub. Date: May 27, 1999

(30) Foreign Application Priority Data

Nov. 14, 1997 (JP) ..... 9-331102

(51) Int. Cl.[7] ..... F28F 9/02

(52) U.S. Cl. ..... 165/175; 165/140; 165/149; 165/153; 165/173

(58) Field of Search ..... 165/173, 175, 165/153, 149, 174, 176, 140

(56) References Cited

U.S. PATENT DOCUMENTS 3,866,675 * 2/1975 Bardon et al. ..... 165/173
4,936,381 * 6/1990 Alley ..... 165/176
5,207,738 * 5/1993 Dey ..... 165/175
5,265,672 * 11/1993 Aoki ..... 165/149
5,836,384 * 11/1998 Wijkstrom et al. ..... 165/173

FOREIGN PATENT DOCUMENTS

1336583 * 7/1963 (FR) ..... 165/177
4-92176 8/1992 (JP) .
8-226786 9/1996 (JP) .
8-1640 12/1996 (JP) .

* cited by examiner

*Primary Examiner*—Leonard Leo
(74) *Attorney, Agent, or Firm*—Wenderoth, Lind & Ponack, L.L.P.

(57) ABSTRACT

The present invention provides a radiator achieving a structure that enables integrated brazing, facilitates mounting of an automatic oil cooler and repair on areas with defective brazing and realizes good mountability and recyclability. A tank portion 4 at which tubes 2 of the radiator are inserted is constituted of a first L-shaped tank member 30 and a second L-shaped tank member 40. Prior to the process for assembling the tank portion 4, intake/outlet pipes 9 and 10 are mounted at the first L-shaped tank member 30 and an A/T oil cooler 46 is mounted at the second L-shaped tank member 40 to facilitate mounting of the A/T oil cooler 46 inside the tank portions 4. In addition, since at least the tank portion 4, the tubes 2, the fins 3 and the side plate 11 are brazed together as an integrated unit in a furnace, the production of the radiator is facilitated.

40 Claims, 21 Drawing Sheets

(a)

(b)

(a)

(b)

(a)

(b)

(c)

(a)

(b)

(c)

(a)

(b)

(a)

(b)

(a)

(b)

HEAT EXCHANGER

TECHNICAL FIELD

The present invention relates to a heat exchanger, and more specifically, it relates to a heat exchanger that is ideal in application as a radiator for vehicles.

BACKGROUND ART

The heat exchanger for vehicles disclosed in Japanese Unexamined Utility Model Publication No. H1-61582 is achieved by forming a heat exchanger for engine cooling water, a heat exchanger for air conditioning and other heat exchangers as an integrated unit, with each heat exchanger provided with a core constituted of a plurality of tubes and fins secured in contact with the tubes and a tube plate that covers the ends of tubes belonging to two cores collectively. In addition, a groove is formed at the circumferential edge of the tube plate, and the bottom portion of the tank main body constituted of a synthetic resin is fitted and fastened through calking at the groove.

The radiator illustrated in FIG. 23(*a*) is a so-called downflow radiator and assumes a structure similar to that described above. In more specific terms, this radiator 100 is provided with tank main bodies 102 and 103 constituted of a synthetic resin and disposed at the top and the bottom of a core main body 101 constituted of tubes 104 and fms 105 both constituted of aluminum alloy. As shown in FIG. 23(*b*), the tank main bodies 102 and 103 each have a flange portion 108 which is fitted via an o-ring at a groove 107 formed at the periphery of an end plate 106 to which ends of the tubes 104 are mounted and the tank main bodies 102 and 103 are each further fastened by using calking tabs 109 formed over specific intervals at the circumferential edge of the end plate 106.

It is to be noted that in FIG. 23(*a*) illustrating the radiator 100, reference number 110 indicates an intake pipe through which engine cooling water is guided into the upper tank main body 102 and reference number 111 indicates an outlet pipe through which the engine cooling water is discharged from the lower tank main body 103. In addition, a cooling water induction port 116, which is closed off by a cap 112 having a pressure valve, for instance, is provided at the upper tank main body 102. Inside the lower tank main body 103, an oil cooler is provided, and reference numbers 114 and 115 indicate intake/outlet pipes of the oil colors.

However, in the structure of the prior art described above, in which the tubes and the fins constituting the core are formed from aluminum alloy and the tank main bodies are formed from a synthetic resin, there is a problem in that they cannot be formed together. There is another problem in that the recyclability of the radiator itself is poor.

As a solution, a method achieved by forming the members constituting the tank portions with aluminum alloy and then the aluminum alloy tank portions are brazed together with the core in a furnace to achieve an integrated unit may be proposed. However, a problem occurs during the repair process implemented after the brazing process to repair any defective brazing occurring between the individual members constituting the tank portions by means such as torch brazing or the like that is, the brazed areas between the individual members are close to the tubes and fins, the tubes and fins become melted during the repair process.

In addition, while the oil cooler for cooling the automatic transmission oil (hereafter referred to as the A/T oil cooler) is mounted at the same time inside the outlet-side (lower) tank main body 103 in the radiator, if U-shaped tank plates are used, the intake/outlet pipes of the A/T oil cooler become a hindrance to the assembly work. Furthermore, while the intake/outlet pipes of the A/T oil cooler may be enclosed and brazed between the tank plates, this method poses problems in that the shapes in the vicinity of the insertion holes for the intake/outlet pipes are bound to become complicated and in that good brazing is not achieved for the intake/outlet pipes, the tank plates and the like.

An object of the present invention is to provide a heat exchanger with a structure that allows integrated brazing, that achieves an improvement in the assemblability in the mounting of the A/T oil cooler and also achieves good overall assemblability and good recyclability.

SUMMARY OF THE INVENTION

Accordingly, in the heat exchanger according to the present invention, which is provided with, at least, a tank portion, tubes communicating with the tank portion and fins provided between the tubes, the tank portion comprises a first L-shaped tank member constituted of a mounting wall at which the plurality of tubes are inserted and a first wall that extends from the edge of the mounting wall along the lengthwise direction by a specific length in the direction in which the tubes are inserted, a second L-shaped tank member which is bonded at an end of the mounting wall of the first L-shaped tank member, and blocking members provided at the two ends along the direction of the length of the first and second L-shaped tank members. At and at least the first and second L-shaped tank members, the tubes and the fins are brazed together in a furnace to achieve an integrated unit. In addition, it is desirable to constitute the first and second L-shaped tank members, the tubes, the fins and the side plate with aluminum alloy. The cross sections of the first L-shaped tank member and the second L-shaped tank member should achieve an L shape or an irregular J shape.

As a result, the radiator according to the present invention, which achieves a structure allowing integrated brazing, realizes a reduction in assembly costs and improves recyclability. In addition, since the tank portion is constituted of the first and second L-shaped tank members, the A/T oil cooler only needs to be mounted at one of the L-shaped tank members before the assembly process, so that ease of assembly is achieved when mounting the A/T oil cooler at the tank.

Furthermore, since half of the brazed area in the components constituting the tank portion is distanced from the tubes and the fins, repair on an area where full brazing has not been achieved is facilitated. In addition, the problem of the tubes or the fins becoming melted during a repair process implemented by means such as torch brazing is prevented in the area distanced from the brazed area.

The blocking members are each constituted as a plate having an external circumferential edge conforming to the internal circumferential side surfaces of the first L-shaped tank member and the second L-shaped tank member, and are each provided with a first positioning projected portion projecting out toward the mounting wall and a second positioning projected portion projecting out toward the second tank member. The first positioning projected portion is inserted in a first positioning hole formed at a specific position in the mounting wall at the first L-shaped tank member in the vicinity of an end in the lengthwise direction, and the second positioning projected portion is inserted in a second positioning hole formed at a specific position at the second L-shaped tank member in the vicinity of an end along the lengthwise direction. As a result, the blocking members positioned at the two ends of the tank members along the lengthwise direction are held securely prior to the brazing process to ensure that brazeability is improved.

In addition, the intake/outlet pipes through which the heat exchanging medium travels are formed at the first wall of the first L-shaped tank member. As a result, the intake/outlet pipes are not formed astride two different members. Furthermore, since the oil cooler is provided at a first wall of the second L-shaped tank member, the intake/outlet pipes of the oil cooler do not interfere prior to the assembly process to achieve easy assembly.

The cross sections of the first and second L-shaped tank members are either L-shaped or J-shaped. In addition, a fitting groove is formed at the mounting wall of the first L-shaped tank member at an end along the direction of the shorter side of the mounting wall extending along the lengthwise direction with an end of one of the walls of the second L-shaped tank member inserted at the fitting groove. A a fitting groove is formed at one of the walls of the second L-shaped tank member along the lengthwise direction with an end of one of the walls of the first L-shaped tank member inserted at the fitting groove. Thus, since the first L-shaped tank member and the second L-shaped tank member are retained with their respective first walls inserted at the fitting grooves, the tank portion can be fixed firmly during the preliminary assembly process implemented prior to the brazing process.

Alternatively, instead of the fitting grooves, a staged portion extending along the lengthwise direction that comes in contact with the first wall of the first L-shaped tank member may be formed at an end of the second wall of the second L-shaped tank member, or a holding wall extending along the lengthwise direction that comes in contact with the outer side of an end of the first wall of the first L-shaped tank member, may be formed at an end of the second wall of the second L-shaped tank member.

By providing calking tabs at the fitting grooves formed at the first walls of the first and second L-shaped tank members and bending the calking tabs toward the first wall surfaces, preliminary assembly can be implemented with a high degree of reliability prior to brazing.

Retaining members that connect with the fitting grooves and the first walls of the first and second L-shaped tank members inserted inside the fitting grooves are formed, and with the retention achieved by the retaining members, the first L-shaped tank member and the second L-shaped tank member are pre-assembled together prior to the brazing process. The retaining members are each constituted of a retaining projected portion and a retaining indented portion.

The distance over which the pair of positioning projected portions facing opposite each other at the blocking plate is set smaller than the thickness of the second L-shaped tank member. Since this setting ensures that the positioning projected portions do not project out further relative to the positioning holes and thus, do not come in contact with the tightening jig, reliable assembly is assured. Alternatively, the distance over which the second positioning projected portion projects out may be set larger than the thickness of the second L-shaped tank member to improve the mountability of the blocking member, and the projected portion may be bent to assure secure holding of the blocking member.

Furthermore, the blocking member is formed together with the side plate as an integrated unit. Thus, the number of parts required is reduced. In addition, the blocking member is provided with a positioning projected portion projecting out at an end of the blocking member formed together with the side plate as an integrated unit, with the positioning projected portion inserted at a positioning through hole formed at a specific position at the second L-shaped tank member in the vicinity of its end along the lengthwise direction. As a result, the blocking member can be positioned at each end of the tank portion along the lengthwise direction with ease.

Also, according to the present invention, at an end of the mounting wall of the first L-shaped tank member, a notched portion is formed, and the side plate formed together with the blocking member as an integrated unit is mounted, at the notched portion. Since the presence of the notched portion allows the side plate and blocking member to be formed as an integrated unit on a single straight line, the side plate to be formed as an integrated part of the blocking member can be formed easily. Likewise, with the second L-shaped tank member extending further out relative to the first L-shaped tank member along the lengthwise direction, a positioning hole at which the positioning projected portion of the blocking member formed together with the side plate is inserted may be formed in the extended area. Furthermore, an insertion hole through which the blocking member formed together with the side plate is inserted may be formed in the vicinity of an end of the mounting wall of the first L-shaped tank member.

Moreover, the side plate formed as an integrated part of the blocking member is provided with an arched bypass portion that bypasses an end of the mounting wall along the lengthwise direction at the first L-shaped tank member. This allows the blocking member and the side plate to be formed as an integrated unit without having to change the structure of the end of the tank portion, and the blocking member can be positioned by placing the bypass portion in contact with the end of the mounting wall of the first L-shaped tank member along the lengthwise direction.

Furthermore, according to the present invention, a sacrificial corrosion layer is provided at the surfaces located on the inside of tank portion at the first L-shaped tank member, the second L-shaped tank member and the blocking members constituting the tank portion, and a brazing material layer is provided on the outside of the tank portion. It is to be noted that the sacrificial corrosion layer is constituted of an aluminum alloy containing a metal that demonstrates a higher degree of ionization tendency compared to aluminum. As a result, since the sacrificial corrosion layer is provided at the surfaces located on the inside of the tank portion and the sacrificial corrosion layer becomes corroded through oxidation at an early stage, the material constituting the core of the tank portion formed of aluminum alloy can be prevented from becoming corroded. It is to be noted that it is desirable to constitute the sacrificial corrosion layer with an aluminum alloy containing zinc, achieving a higher degree of ionization tendency compared to that of aluminum. More specifically, it is desirable to constitute the sacrificial corrosion layer with either a 7,000-type or 1,000-type aluminum alloy.

In addition, the brazing material layer should be constituted of an aluminum alloy containing silicon. It may be constituted of a 4,000-type aluminum alloy, which is suited to application as a brazing material. It is to be noted that it is desirable to use a 3,000-type aluminum alloy to constitute the core material.

While it is desirable to constitute the heat exchanger as a cross-flow type one-path heat exchanger or a cross-flow type two-path heat exchanger, the present invention may be adopted in other types of heat exchangers with similar problems to be addressed. It is to be noted that in a one-path heat exchanger, a pair of tank portions are provided at the two ends of the tubes, with an intake pipe provided in an upper portion of one of the tank portions and an outlet pipe provided in a lower portion of the other tank portion. In addition, while a pair of tank portions are provided at the two ends of the tubes when the present invention is adopted in a two-path type heat exchanger, an intake pipe is provided in an upper portion of one of the tank portions which is divided into two tanks by a partitioning wall and an outlet pipe is provided in a lower portion of the same tank portion with the other tank portion constituting a U-turn passage for a cooling fluid. Furthermore, other types of heat exchangers that may adopt the present invention include a heat exchanger that is provided with, at least, one tank portion having two tanks achieved by the presence of a partitioning wall and U-shaped tubes communicating between the tanks.

BRIEF DESCRIPTION OF THE DRAWINGS

FIGS. 9(*a*) and (*b*) illustrate the eighth embodiment, with

FIG. 9(*a*) presenting a perspective of the tank members provided with calking tabs at the fitting grooves to achieve a preliminary retaining effect and FIG. 9(*b*) presenting a perspective of the same tank members viewed from another direction;

FIG. 11(*a*) presents variations of FIGS. 10(*a*)~(*c*), with

FIG. 11(*a*) presenting the twelfth embodiment,

FIG. 11(*b*) presenting the thirteenth embodiment and

FIG. 11(*c*) presenting the fourteenth embodiment;

DETAILED DESCRIPTION OF

Figure 1:
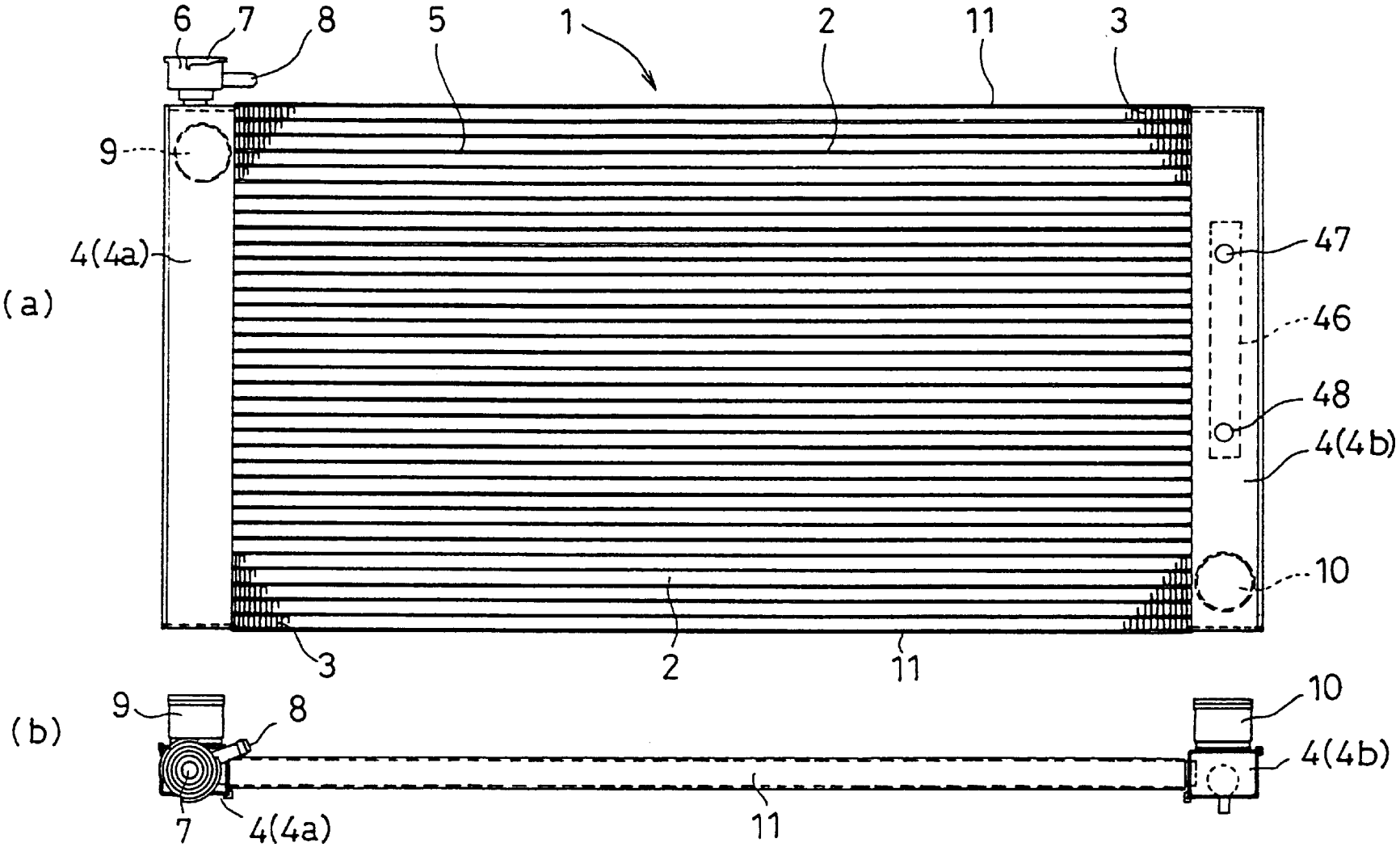
FIG. 1(*a*) is a front view of a one-path radiator in an embodiment of the present invention and FIG. 1(*b*) is a side elevation of the one-path radiator.

FIGS. 1(*a*) and (*b*) illustrate a one-path cross flow type heat exchanger particularly suited in application as a radiator. The heat exchanger 1 constituting a radiator (hereafter referred to as the radiator) comprises a radiator core 5 constituted of a plurality of aluminum alloy tubes 2 and fins 3 provided in contact with the individual tubes 2 between the plurality of tubes 2, tank portions 4 (4*a* and 4B) provided on the two sides of the radiator core 5 with the ends of the tubes 2 on the two sides inserted therein, and side plates 11 and 11 located at the two ends along the direction in which the tubes 2 and the fins are laminated.

A cooling water induction port 6 is provided to bring in cooling water constituting a cooling fluid at one of the tank portions, i.e., the tank portion 4*a*, and the opening of the cooling water induction port 6 is closed off by a cap 7 provided with a pressure valve. The cooling water induction port 6 is provided with an overflow pipe 8. In addition, an intake pipe 9 for taking in the cooling water is provided at an upper portion of the tank portion 4*a*, and an outlet pipe 10 for discharging the cooling water is provided at a lower portion of the other tank portion 4*b*.

Thus, the cooling water having cooled the engine enters one of the tank portions, i.e., the tank portion 4*a*, through the intake pipe 9 and travels from the tank portion 4*a* through the tubes 2 to enter the other tank portion 4*b*. During this process, the cooling water radiates heat into the air passing through the fins 3 to become cooled. Then, it is returned to the engine side from the other tank portion 4*b* via the outlet pipe 10. In addition, if the internal pressure at the tank portion 4*a* rises to a degree exceeding a specific level, the pressure valve provided at the cap 7 opens to allow the cooling water to flow out through the overflow pipe 8 to adjust the pressure inside the radiator 1.

An automatic transmission oil cooler (hereafter referred to as an A/T oil cooler) 46 (to be explained in further detail below) is provided inside the tank portion 4*b*, and an intake pipe 47 and an outlet pipe 48 project from the tank portion 4*b* to the outside while secured to the tank portion 4*b*. As a result, cooling occurs when the cooling water flows into the tank portion 4*b*.

Figure 2:
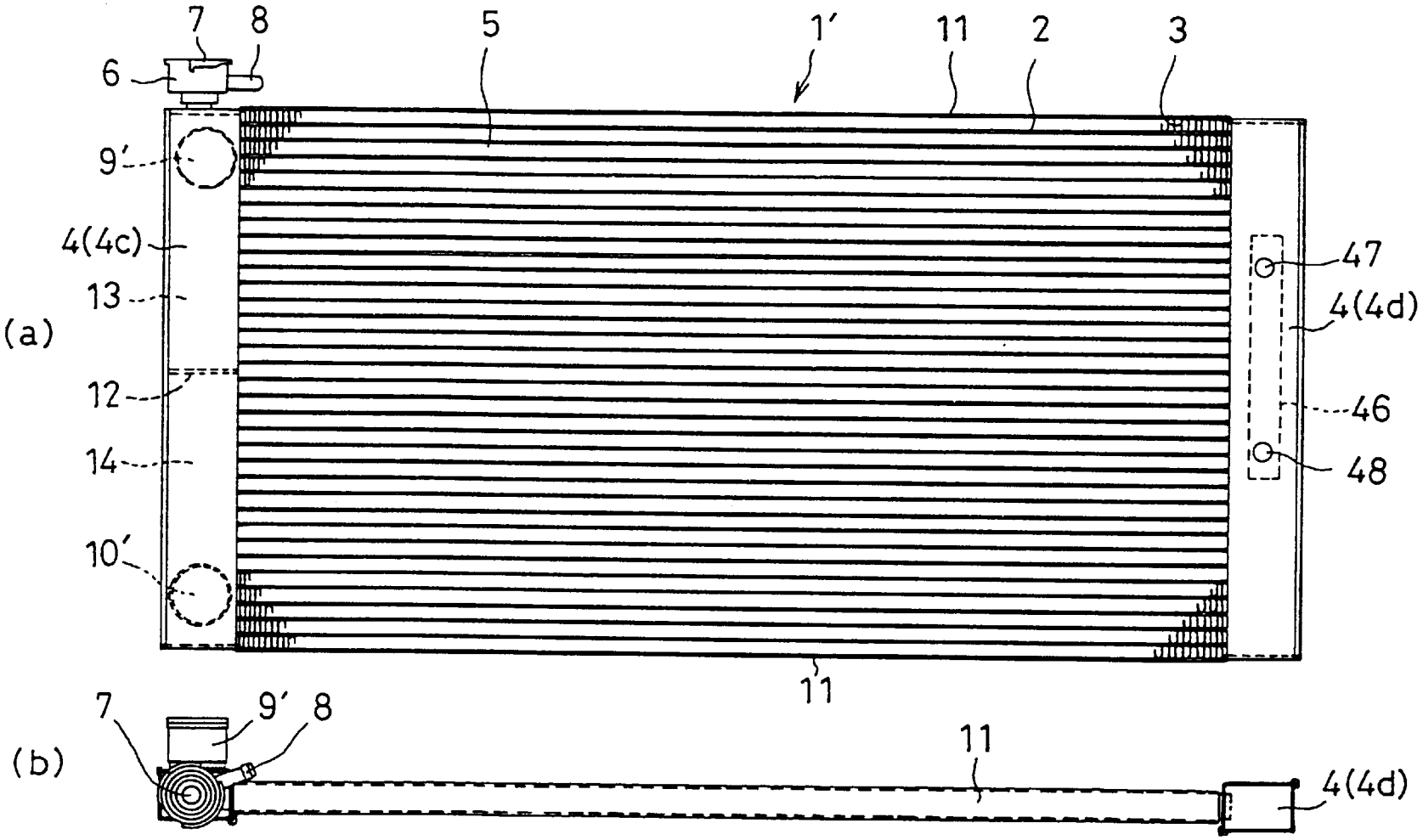
FIG. 2(*a*) is a front view of a two-path radiator in an embodiment of the present invention and FIG. 2(*b*) is a side elevation of the two-path radiator.

FIGS. 2(*a*) and (*b*) illustrate a two-path cross flow type radiator. The radiator 1' comprises a radiator core 5 constituted of a plurality of aluminum alloy tubes 2 and fins 3 provided in contact with the individual tubes 2 between the plurality of tubes 2, tank portions 4 (4*c* and 4*d*) provided on the two sides of the radiator core 5 with the ends of the tubes 2 on both sides inserted therein, and side plates 11 and 11 located at the two ends along the direction in which the tubes 2 and the fins 3 are laminated.

A cooling water induction port 6 is provided to bring in cooling water constituting a cooling fluid at one of the tank portions, i.e., the tank portion 4*c*, and the opening of the cooling water induction port 6 is closed off by a cap 7 provided with a pressure valve. The cooling water induction port is provided with an overflow pipe. In addition, the tank portion 4*c* is divided into an upper tank portion 13 and a lower tank portion 14 by a partitioning wall 12. A cooling water intake pipe 9' is provided in an upper portion of the upper tank portion 13 and an outlet pipe 10' for discharging the cooling water is provided in a lower portion of the lower tank portion 14.

Thus, the cooling water having cooled the engine enters the upper tank portion 13 of the tank portion 4*c* through the intake pipe 9 and travels from the upper tank portion 13 through the tubes 2 to enter the other tank portion 4*d*. Then, it travels downward after making a U-turn at the other tank portion 4*d* and passes through the tubes 2 to enter the lower tank portion 14. Its heat is radiated into the air passing through the fins 3 during this process and, as a result, the cooling water is cooled. Finally, it is returned to the engine side from the lower tank portion 14 via the outlet pipe 10. In addition, if the internal pressure at the upper tank portion 13 rises to a level higher than a specific level, the pressure valve provided at the cap 7 opens to allow the cooling water to flow out through the overflow pipe 8 to adjust the temperature inside the radiator 1.

In the two-path cross flow type radiator 1', too, an A/T oil cooler 17 is provided inside the tank portion 4*b*, as in the radiator 1 described earlier, and an intake pipe 18 and an outlet pipe 19 project from the tank portion 4*b* to the outside while secured to the tank portion 4*b*. As a result, cooling occurs when the cooling water flows into the tank portion 4*b*.

Figure 3:
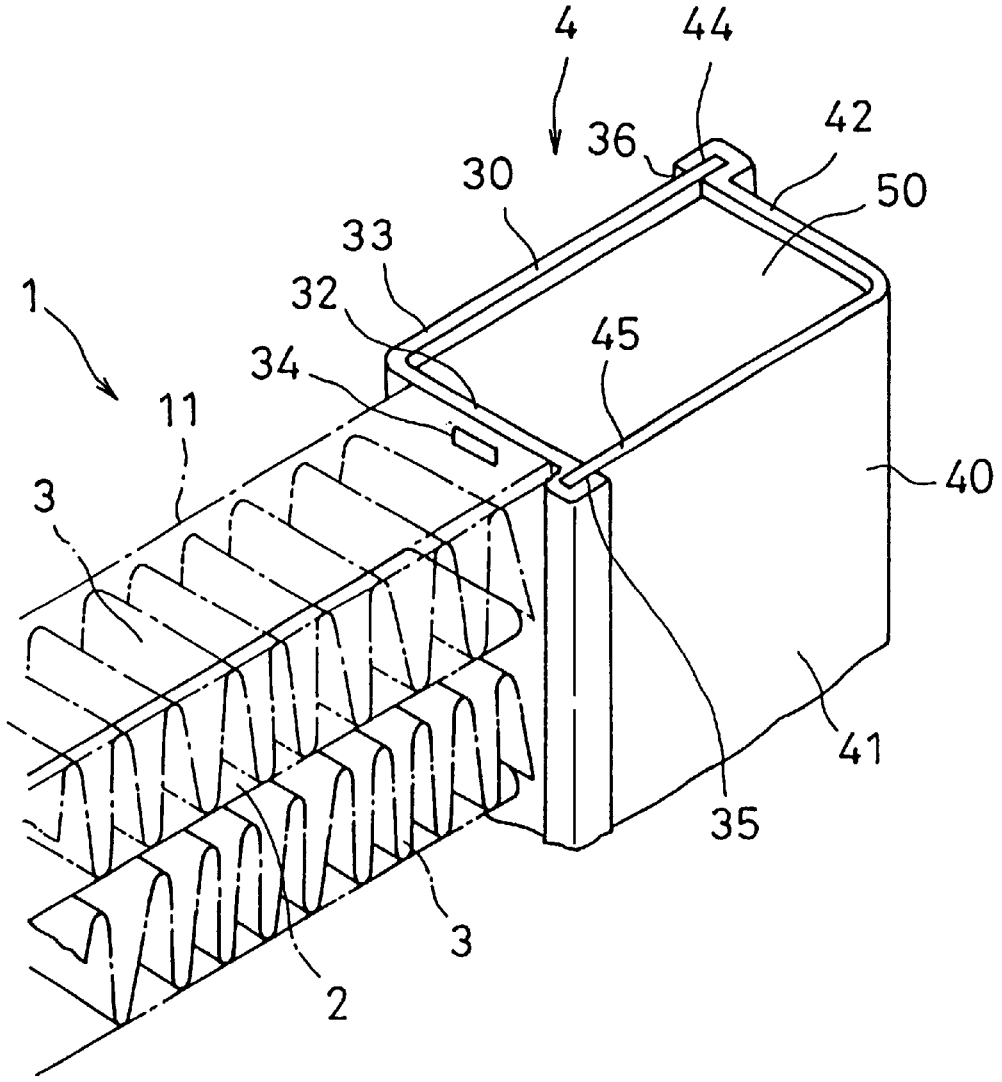
FIG. 3 is an enlarged partial perspective of the area near one end of a tank portion having a first L-shaped tank member and a second L-shaped tank member in the first embodiment of the present invention.
Figure 4:
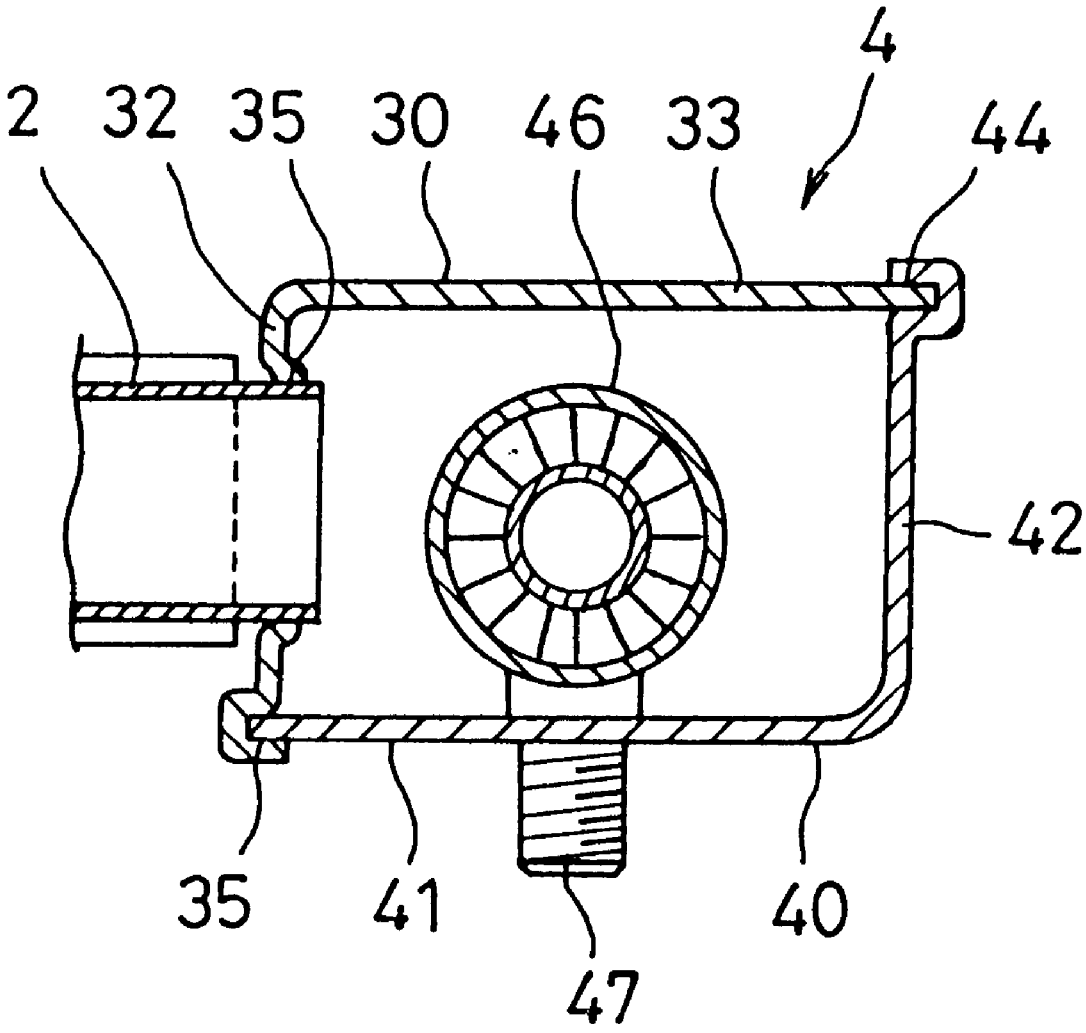
FIG. 4 is an enlarged sectional view of the tank portion in the first embodiment.
Figure 5:
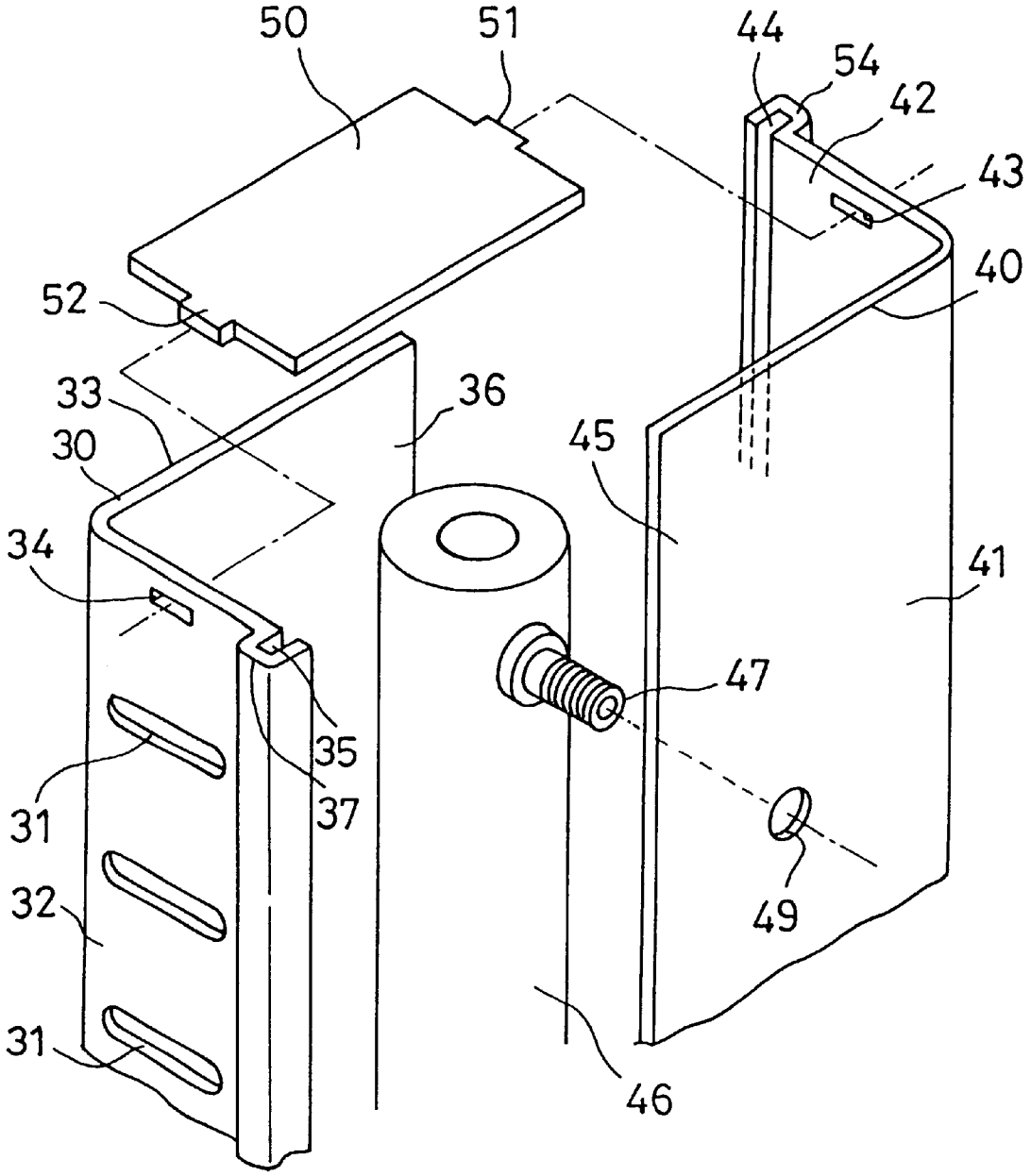
FIG. 5 is an enlarged exploded perspective of the area shown in FIG. 3.

The tank portions 4 in the first embodiment adopted in the radiators 1 and 1' structured as described above each comprise a first L-shaped tank member 30 to which the tubes 2 are inserted and mounted, a second L-shaped tank member 40 which is bonded along the direction of the length of the first L-shaped tank member 30 and blocking members (blocking plates) 50 that block the openings at the two ends along the lengthwise direction of the first and second L-shaped tank members 30 and 40, as illustrated in FIGS. 3, 4 and 5.

As illustrated in FIG. 5, the first L-shaped tank member 30 is constituted of a mounting wall 32 having a plurality of insertion holes 31, to which the tubes 2 are to be inserted, formed therein and a first wall 33, which extends over a specific distance along the direction in which the tubes 2 are inserted from one end of the mounting wall 32 in the direction of the short side, and the first L-shaped tank member 30 achieves an L-shaped cross section formed from the mounting wall 32 and the first wall 33. In addition, a fitting hole 34 to be used for positioning positioning is formed at a specific position near the two ends of the mounting wall 32 along the lengthwise direction, and; positioning projected portion (second projected portion) 52 of the blocking plate 50 to be detailed below is fitted in the fitting hole 34. The first L-shaped tank member 30 is also provided with an indented fitting groove 35 formed along the lengthwise direction at the end (opposite from the side on which the first wall is present) 37 along the direction of the short side of the mounting wall 32.

The second L-shaped tank member 40 is constituted of a first wall 41, which is inserted at the fitting groove 35 formed at one end of the mounting wall 32 of the first L-shaped tank member 40, and a second wall 42 extending along the lengthwise direction at one end of the first wall 41 along the direction of the short side, and achieves an L-shaped cross section formed by the first wall 41 and the second wall 42. In addition, a fitting hole 43 for positioning is formed at a specific position at the two ends of the second wall 42 along the lengthwise direction, and; a positioning projected portion (first projected portion) 51 of the blocking plate 50 to be detailed below is fitted in the fitting hole 43. Furthermore, the second L-shaped tank member 40 is provided with a fitting groove 44 formed along the lengthwise direction at an end (on the opposite side from the side on which the first wall is present) 54 of the second wall 42 along the direction of the short side. One end of the first wall 33 of the first L-shaped tank member 30 is inserted at the fitting groove 44.

At the blocking plate 50, the first projected portion 51 to be inserted at the fitting hole 43 and the second projected portion 52 to be inserted at the fitting hole 34 are formed. When the first L-shaped tank member 30 and the second L-shaped tank member 40 are bonded to each other, the second projected portion 52 is fitted in the fitting hole 34 and the first projected portion 51 is fitted in the fitting hole 43 so that the blocking plate 50 is clamped and secured between the first L-shaped tank member 30 and the second L-shaped tank member 40.

Thus, since half of the area over which the first L-shaped tank member 30 and the second L-shaped tank member 40 are brazed together is distanced from the tubes 2 and the mounting wall 32 of the first L-shaped tank member 30, repair to be implemented through torch brazing or the like if there is any defective brazing, is facilitated. Also, the tubes 2 and the fins are not caused to melt while repairing the bonded area on the distant side.

In addition, since the first and second projected portions 51 and 52 of the blocking plate 50 are fitted in the fitting holes 43 and 34, the end 36 of the first wall 33 of the first L-shaped tank member 30 is fitted in the fitting groove 44 of the second L-shaped tank member 40 and the end 45 of the first wall 41 of the second L-shaped tank member 40 is fitted in the fitting groove 35 of the first L-shaped tank member 30, as illustrated in FIGS. 3 and 4, preliminary assembly performed prior to the brazing process is facilitated.

The automatic transmission (A/T) oil cooler 46 is housed inside the tank 4, and is mounted inside the first wall 41 of the second L-shaped tank member 40 via the intake/outlet pipes 47 and 48, with the intake/outlet pipes 47 and 48 each inserted at a hole 49 formed in the first wall 41 of the second L-shaped tank member 40 and projecting to the outside. Oil flows via the intake/outlet pipes 47 and 48 to achieve heat exchange for the cooling water flowing inside the tank 4. Since the A/T oil cooler 46 is bonded to the first L-shaped tank member 30 after it is mounted in the second L-shaped tank member 40, no problem arises with respect to mounting the A/T oil cooler 46.

Figure 6:
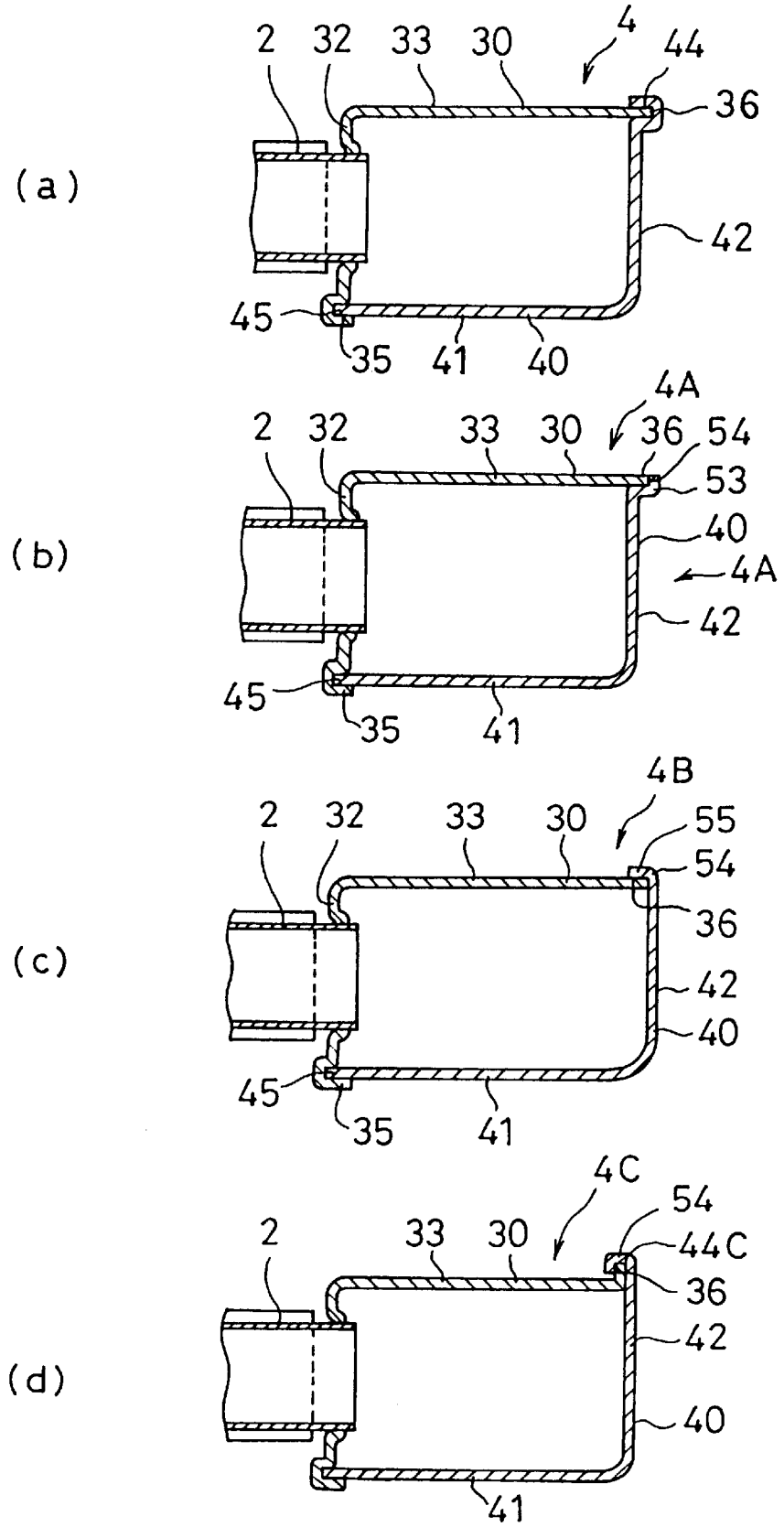
FIGS. 6(*a*)–(*d*) are sectional views presenting examples of bonding structures that may be adopted when bonding the first wall of the first L-shaped tank member and the second wall of the second L-shaped tank member constituting the tank portion with FIG. 6(*a*) representing the first embodiment, FIG. 6(*b*) representing the second embodiment, FIG. 6 (*c*) representing the third embodiment and FIG. 6(*d*) representing the fourth embodiment.
Figure 7:
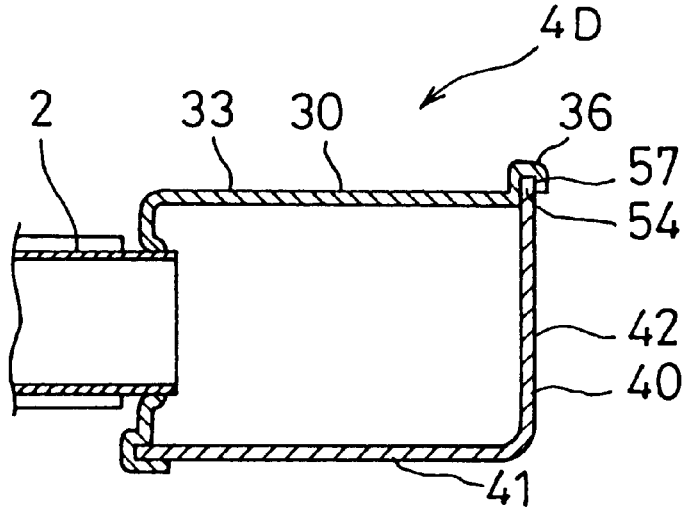
FIG. 7 is a sectional view similar to the previous sectional views but presenting the fifth embodiment.

Variations of the example explained above (illustrated in FIG. 6(*a*)) are presented in FIGS. 6(*b*), (*c*) and (*d*) and in FIG. 7, which present examples of bonding structures that may be adopted for the first wall 33 of the first L-shaped tank member 30 and the second wall 42 of the second L-shaped tank member 40 constituting a tank portion. In the second embodiment illustrated in FIG. 6(*b*), a stage 53 is formed at the end 54 of the second wall 42 in the second L-shaped tank member 40, and the stage 53 is constituted of a portion that comes in contact with the inner surface of the end 36 of the first wall 33 of the first L-shaped tank member 30 constituting a tank portion 4A and a portion that comes into contact with the end surface of the end 36. As a result, the first wall 33 and the second wall 42 are held in contact with each other. It is to be noted that the same reference numbers are assigned to components identical to those in the first embodiment to preclude the necessity for repeated explanation thereof.

In the third embodiment shown in FIG. 6(*c*), a holding wall 55 is formed by bending the end 54 of the second wall 42 of the second L-shaped tank member 40 constituting a tank portion 4B toward the tubes The inner surface of the holding wall 55 is placed in contact with the outer surface of the end 36 of the first wall 33 to hold the first wall 33 by enclosing the first wall 33 from the outside.

In the fourth embodiment illustrated in FIG. 6(*d*), the end 36 of the first wall 33 of the first L-shaped tank member 30 constituting a tank portion 4C is bent outward, and a fitting groove 44*c* is formed at the end 54 of the second wall 42 in the second L-shaped tank member 40 so as to enclose the end portion.

In the fifth embodiment shown in FIG. 7, a fitting groove 57 is formed perpendicular to the tubes 2 at the end 36 of the first L-shaped tank member 30 constituting a tank portion 4D, and the end 54 of the second wall 42 in the second L-shaped tank member 40 is inserted within the fitting groove 57.

Figure 8:
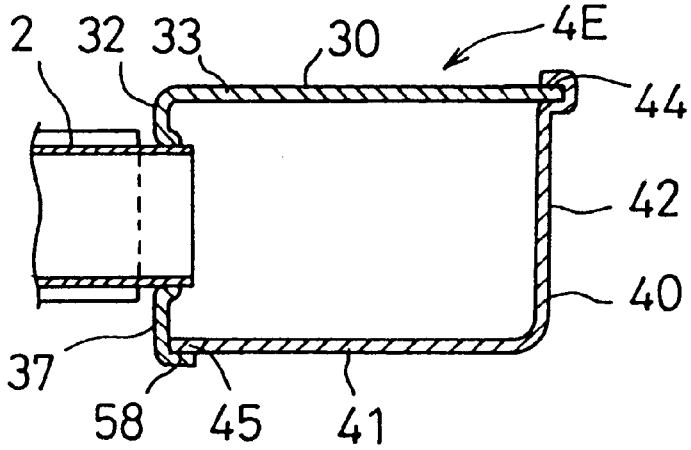
FIGS. 8(*a*) and (*b*) are sectional views presenting examples of bonding structures that may be adopted when bonding the mounting wall of the first L-shaped tank member and the first wall of the second L-shaped tank member constituting the tank portion with FIG. 8(*a*) representing the sixth embodiment and FIG. 8(*b*) representing the seventh embodiment.
Figure 8:
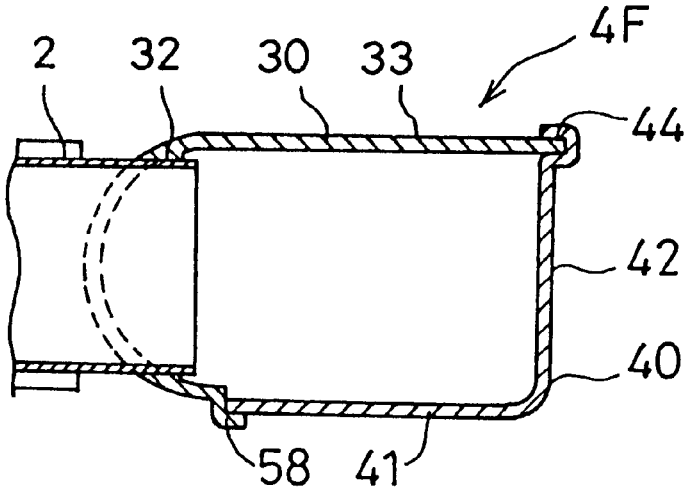

In the sixth embodiment shown in FIG. 8(*a*), which shows an example of a bonding structure that may be adopted when bonding the end 37 of the mounting wall 32 of the first L-shaped tank member 30 constituting a tank portion 4E and an end 45 of the first wall 41 of the second L-shaped tank member 40, the end 37 of the mounting wall 32 is bent inward to form a holding wall 58 and the end 45 of the first wall 41 of the second L-shaped tank member 40 is placed in contact with the holding wall 58.

In the seventh embodiment illustrated in FIG. 8(*b*), which is achieved by modifying the sixth embodiment, the mounting wall 32 of the first L-shaped tank member 30 constituting a tank portion 4F is formed as a projecting surface projecting out toward the tubes.

Figure 9:
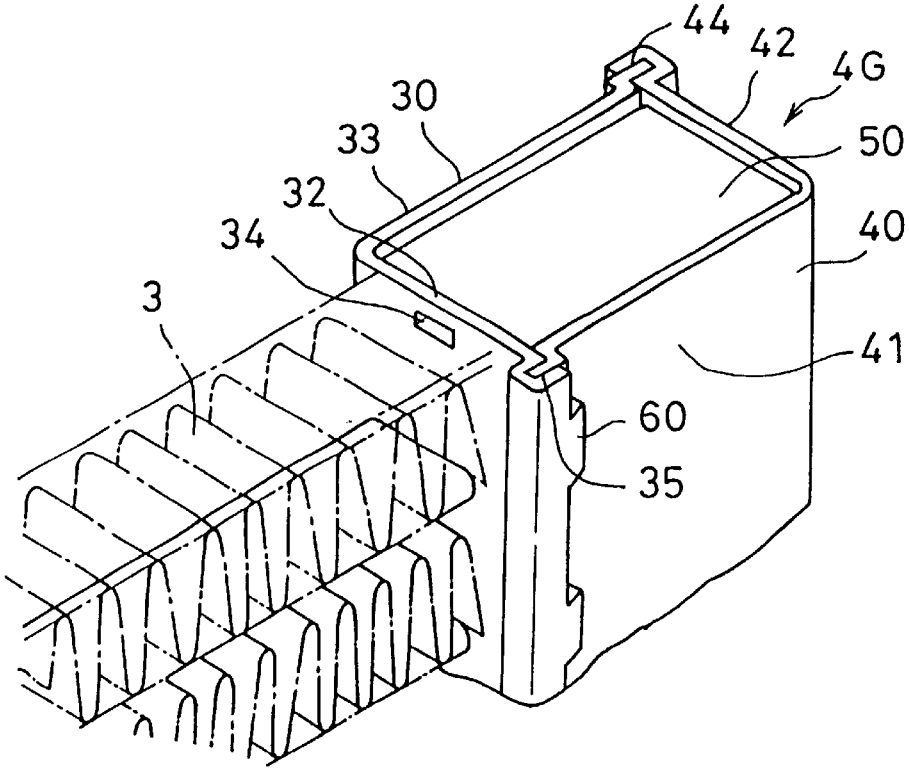
Figure 9:
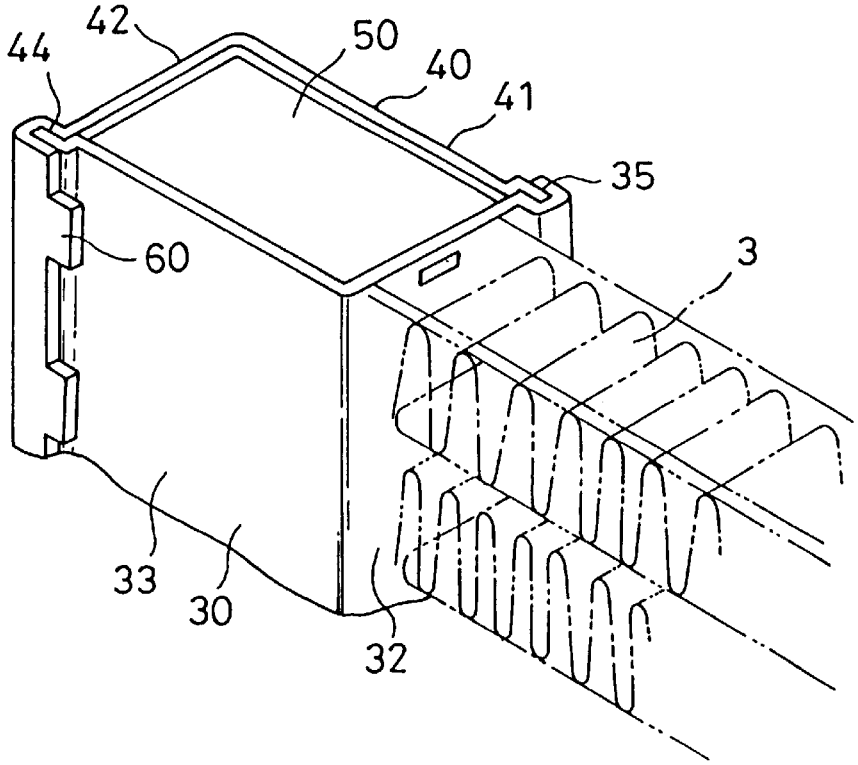

FIGS. 9(*a*) through 11(*a*) present examples in which calking is implemented to achieve an improvement in the preliminary retaining effect achieved in the bonding structure of the first L-shaped tank member 30 and the second L-shaped tank member 40 prior to the furnace brazing process. In the eighth embodiment shown in FIG. 9(*a*) and (*b*), calking tabs 60 and 60 are provided at the fitting groove 35 formed at the mounting wall 32 and the fitting groove 44 formed at the second wall 42 to be used when bonding the mounting wall 32 and the first wall 41, and the first wall 33 and the second wall 42 of the first L-shaped tank member 30 and the second L-shaped tank member 40 constituting a tank portion 4G.

Only the differences from the embodiment shown in FIGS. 9(*a*) and (*b*) are explained with reference to FIGS. 10(*a*) and (*b*). In the ninth embodiment shown in FIG. 10(*a*), calking tabs 60 are provided at a fitting groove 57 formed at the end 36 of the first wall 33 of the first L-shaped tank member 30 constituting a tank portion 4H.

Figure 10:
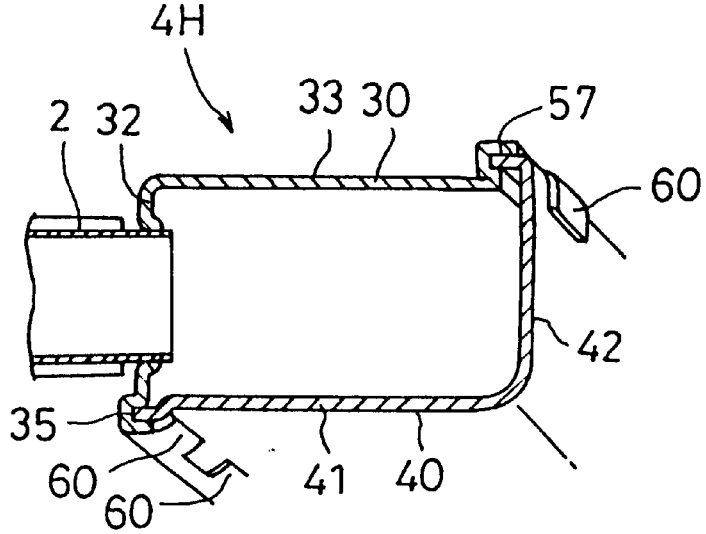
FIGS. 10(*a*)–(*c*) present sectional views of the area around the tank portion pre-retained by the calking tabs formed at the fitting grooves, with FIG. 10(*a*) presenting the ninth embodiment, FIG. 10(*b*) presenting the tenth embodiment and FIG. 10(*c*) presenting the eleventh embodiment.
Figure 10:
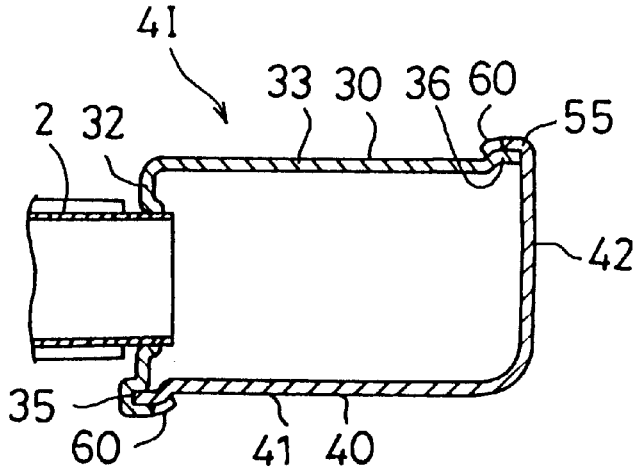
Figure 10:
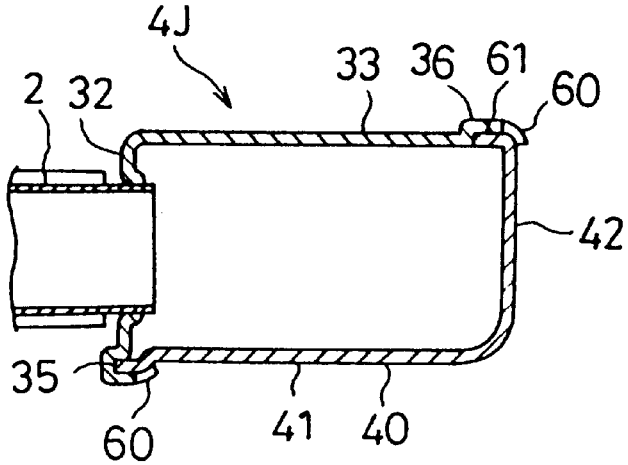

In the tenth embodiment shown in FIG. 10(*b*), in which a holding wall 55 in contact with the outer side of the end 36 of the first L-shaped tank member 30 constituting a tank portion 41 is formed at the second wall 42 of the second L-shaped tank member 40, calking tabs 60 are provided at the holding wall 55.

In the eleventh embodiment shown in FIG. 10(*c*), a stage 61 is formed at the first wall 33 of the first L-shaped tank member 30 constituting a tank portion 4J with the second wall 42 of the second L-shaped tank member 40 in contact with the stage 61, and calking tabs 60 are provided at the stage 61.

Figure 11:
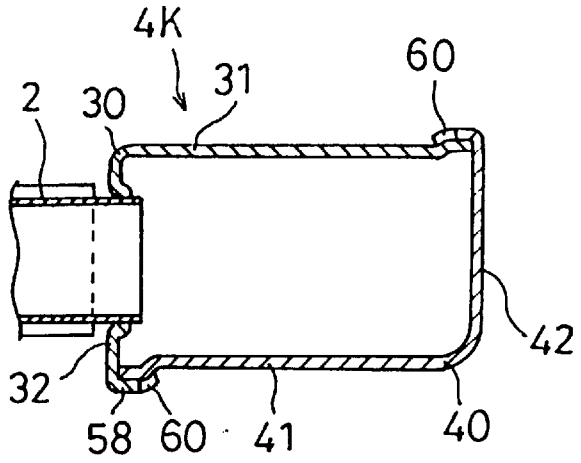
Figure 11:
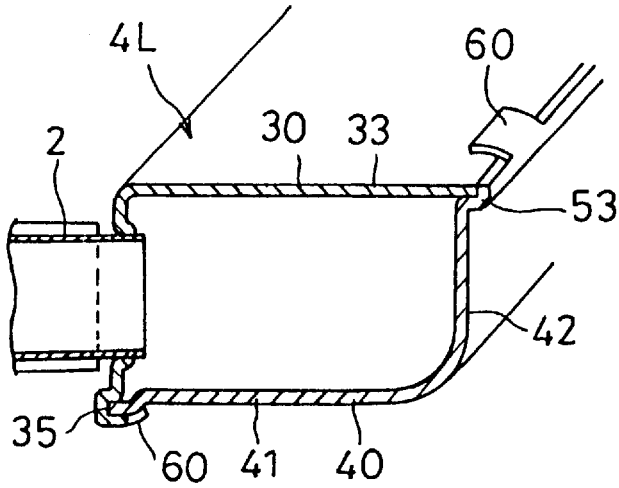
Figure 11:
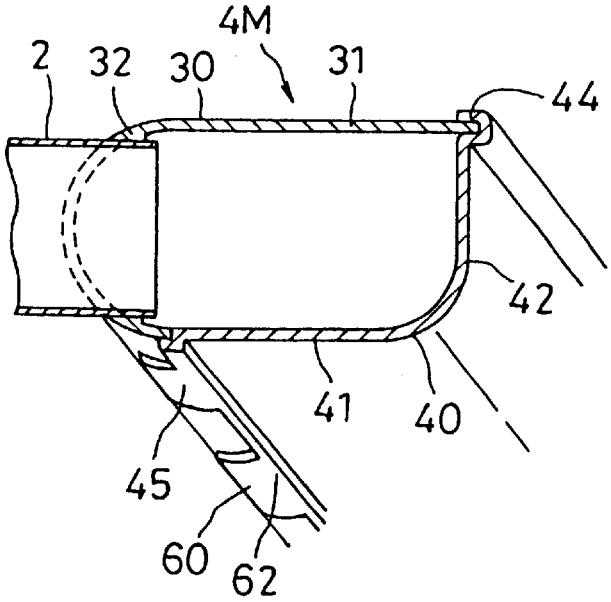

In the twelfth embodiment shown in FIG. 11(*a*), unlike the bonding/calking achieved for the first wall 33 of the first L-shaped tank member 30 and the first wall 41 of the second L-shaped tank member 40 with the example explained earlier in reference to FIG. 10(*b*), the end 37 of the first wall 33 of the first L-shaped tank member 30 constituting a tank portion 4K is bent inward to form a holding wall 58 with the end 45 of the first wall 41 in contact with the inner side of the holding wall 58, and calking tabs 60 are provided at the holding wall 58.

In the thirteenth embodiment shown in FIG. 11(*b*), which is achieved by modifying the embodiment explained earlier with reference to FIG. 6(*b*), calking tabs are provided at a stage 53 that is provided at the end 54 of the second wall 42 of the second L-shaped tank member 40 constituting a tank portion 4L and are in contact with the first wall 33.

In the fourteenth embodiment shown in FIG. 11(*c*), the mounting wall 32 of the first L-shaped tank member 30 constituting a tank portion 4M is formed as a projecting surface projecting toward the tubes, and calking tabs 60 are provided at a stage 62 formed at the end 45 of the first wall 41 of the second L-shaped tank member 40.

Figure 12:
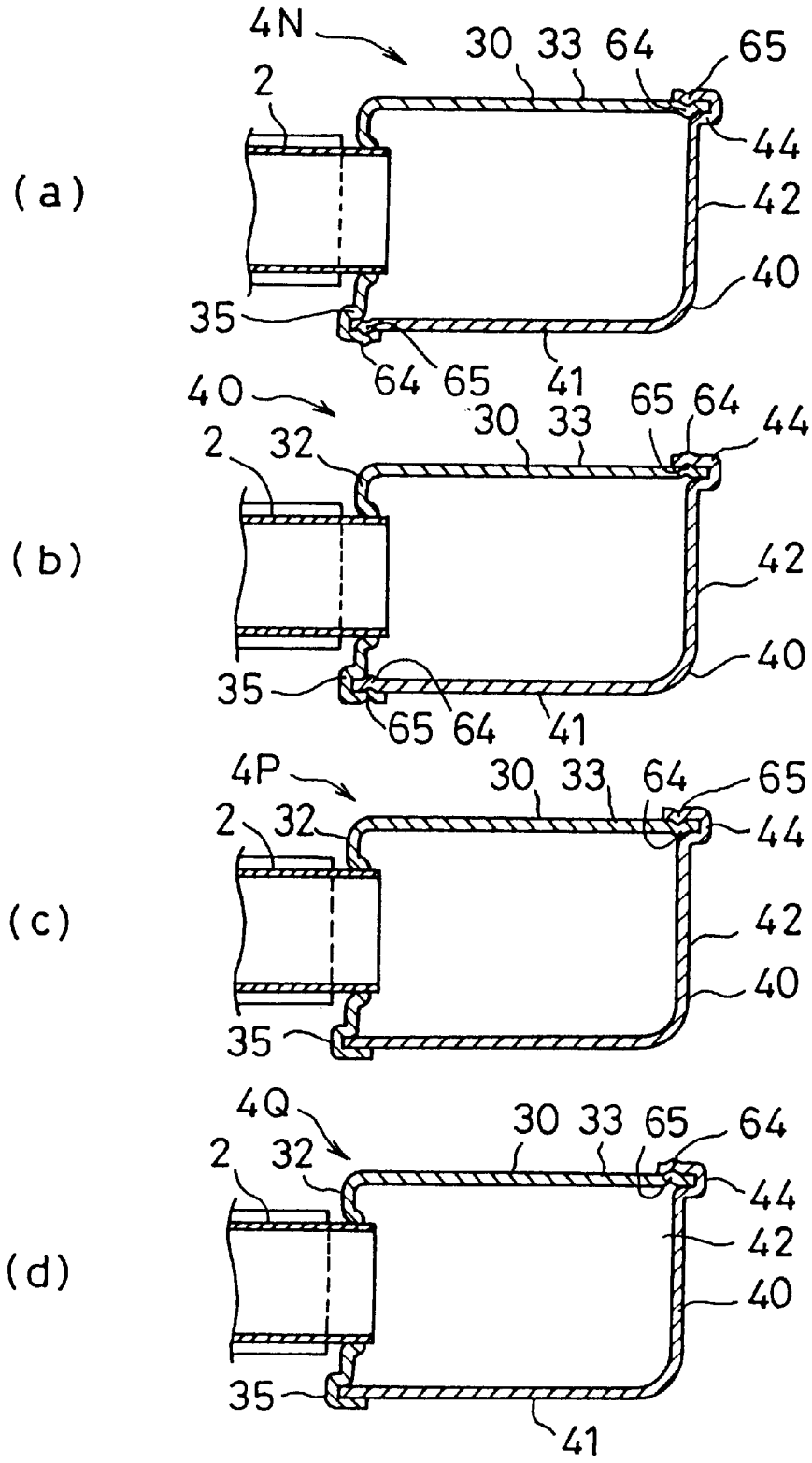
FIGS. 12(*a*)~(*d*) are sectional views presenting examples in which a means for retention is provided to improve the mountability in the bonding structure through which the first L-shaped tank member and the second L-shaped tank member constituting the tank portion are bonded, with FIG. 12(*a*) presenting the fifteenth embodiment, FIG. 12(*b*) presenting the sixteenth embodiment, FIG. 12(*c*) presenting the seventeenth embodiment and FIG. 12(*d*) presenting the eighteenth embodiment.

FIGS. 12(*a*)~(*d*) present examples each provided with a means for retention to improve the mountability in the bonding structure of the first L-shaped tank member 30 and the second L-shaped tank member 40 before the furnace brazing process.

In the fifteenth embodiment shown in FIG. 12(*a*), the first L-shaped tank member 30 and the second L-shaped tank member 40 constituting a tank portion 4N are bonded at two locations, A retaining indented portion 64 is formed at the end 33 of the first wall 33, a retaining projected portion 65, which is retained at the retaining indented portion 64, is formed at the fitting groove 44 formed at the end of the second wall 42. A retaining indented portion 64 is formed at the fitting groove 44 provided at the mounting wall 32, and a retaining projected portion 65, which is retained at the retaining indented portion 64, is formed at the end 45 of the first wall 41.

In the sixteenth embodiment shown in FIG. 12(*b*), a means for retention is formed along a direction opposite from the direction in which the means for retention is formed in the fifteenth embodiment. Namely, a retaining projected portion 65 projecting outward is formed at the end 36 of the first wall 33 in of the first L-shaped tank member 30 constituting a 20 tank portion 40, and a retaining indented portion 64 is formed at the fitting groove 44 formed at the second wall 42 of the second L-shaped tank member 40. A retaining projected portion 65 is formed at the fitting groove 35 provided at the end 37 of the mounting wall 32 of the first L-shaped tank member 30, and a retaining indented portion 64 is formed at the end 45 of the first wall 41 in the second L-shaped tank member 40.

In the seventeenth embodiment shown in FIG. 12(*c*), a means for retention is provided at one of the two areas over which the first and second L-shaped tank members 30 and 40 constituting a tank portion 4P are bonded. Namely, a retaining projected portion 65 is formed at the end 36 of the first wall 33 and a retaining indented portion 64 is formed within the fitting groove 44 formed at the end 54 of the second wall 42.

The eighteenth embodiment shown in FIG. 12(*d*) differs from the seventeenth embodiment in that the means for retention achieves a reverse arrangement. Namely, a retaining projected portion 65 is formed at the end 36 of the first wall 33 of the first L-shaped tank member 30 constituting a tank portion 4Q, and a retaining indented portion 64 is formed inside the fitting groove 44 at the second wall 42 of the second L-shaped tank member 40.

FIGS. 13 through 16 present examples in which the side plate and the blocking plate are formed as an integrated unit to allow the blocking plate to be positioned and held with ease and achieve a reduction in the number of required parts by having the side plate also function as the blocking plate.

Figure 13:
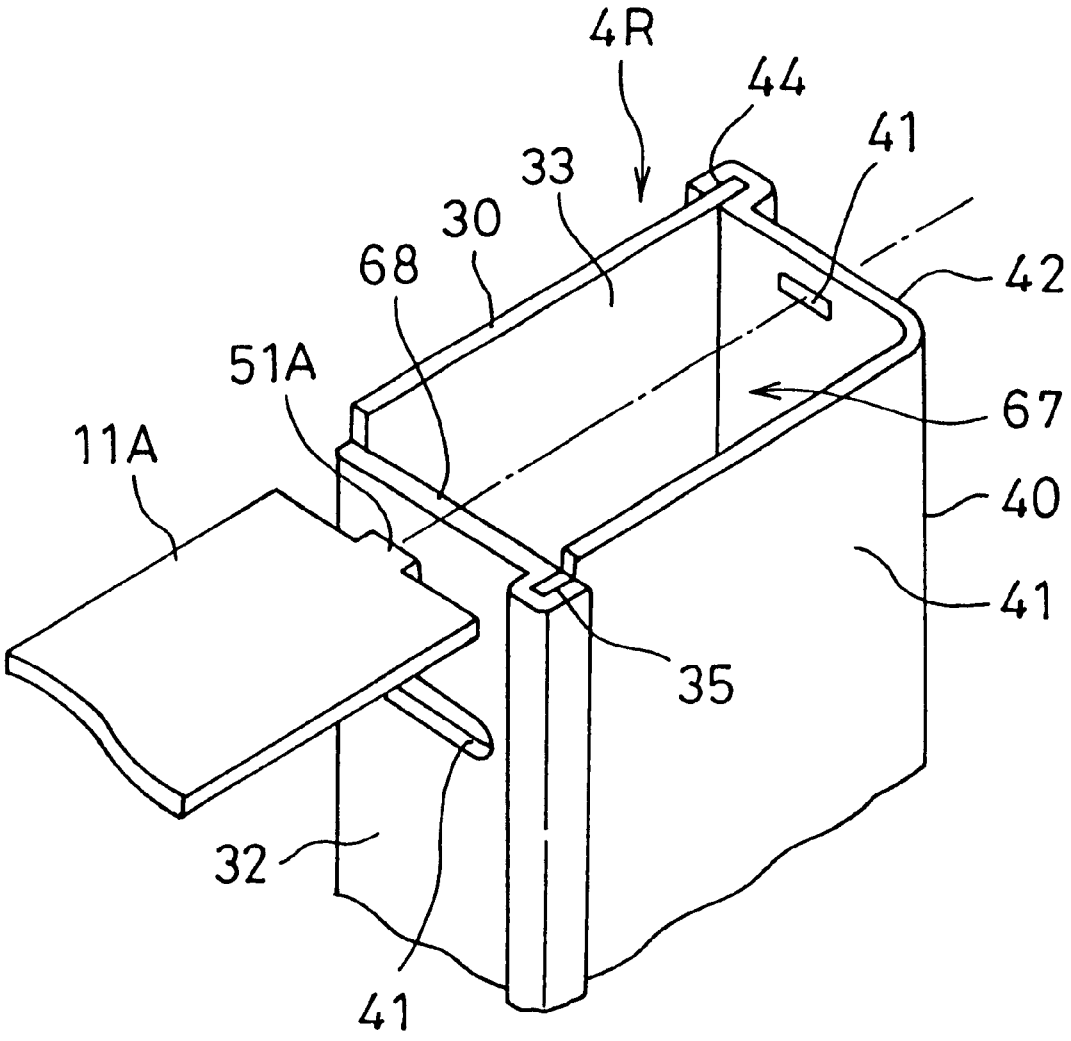
FIG. 13 is a perspective of the nineteenth embodiment achieved by forming the side plate and the blocking plate as an integrated unit and forming a notch at the first L-shaped tank member.

In the nineteenth embodiment shown in FIG. 13, a side plate 11A formed to also function as the blocking plate blocks an opening 67 defined by the first L-shaped tank member 30 and the second L-shaped tank member 40. In this embodiment, a notched portion 68, through which the side plate 11 A is to be inserted, is formed at each the two ends of the mounting wall 32 of the first L-shaped tank member 30 along the lengthwise direction. Thus, the side plate 11A is positioned by fitting a positioning projected portion 51A formed at the tip of the side plate 11A at a fitting hole 43 after it is inserted through the notched portion 68 and the side plate 11A is held by the two first walls 33 and 41 to facilitate preliminary assembly prior to the brazing process.

Figure 14:
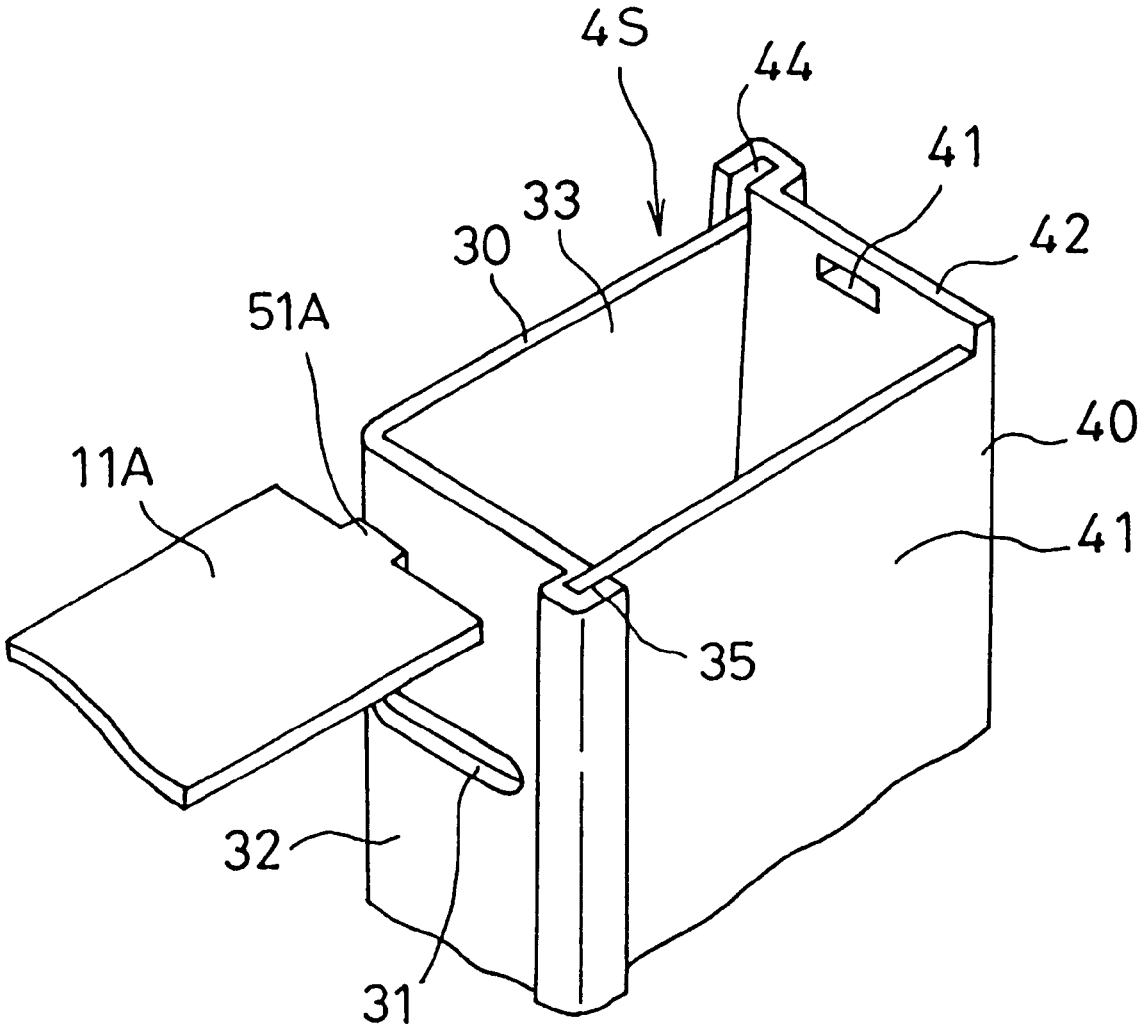
FIG. 14 is a perspective of the tank portion achieved in the twentieth embodiment by forming the side plate and the blocking plate as an integrated unit and extending the second wall of the second L-shaped tank member further out along a lengthwise direction by a specific distance relative to the first L-shaped tank member.

In a tank portion 4S in the twentieth embodiment shown in FIG. 14, the first wall 33 the mounting wall and 32 of the first L-shaped tank member 30 and the first wall 41 of the second L-shaped tank member 40 are notched to reduce their length along the lengthwise direction by a specific amount. Thus, a side plate 11A is positioned at the end of the first and second L-shaped tank members 30 and 40 along the lengthwise direction, and a positioning projected portion 51A formed at the tip of the side plate 11A is fitted inside the fitting hole 43 to close off the opening with a high degree of reliability.

Figure 15:
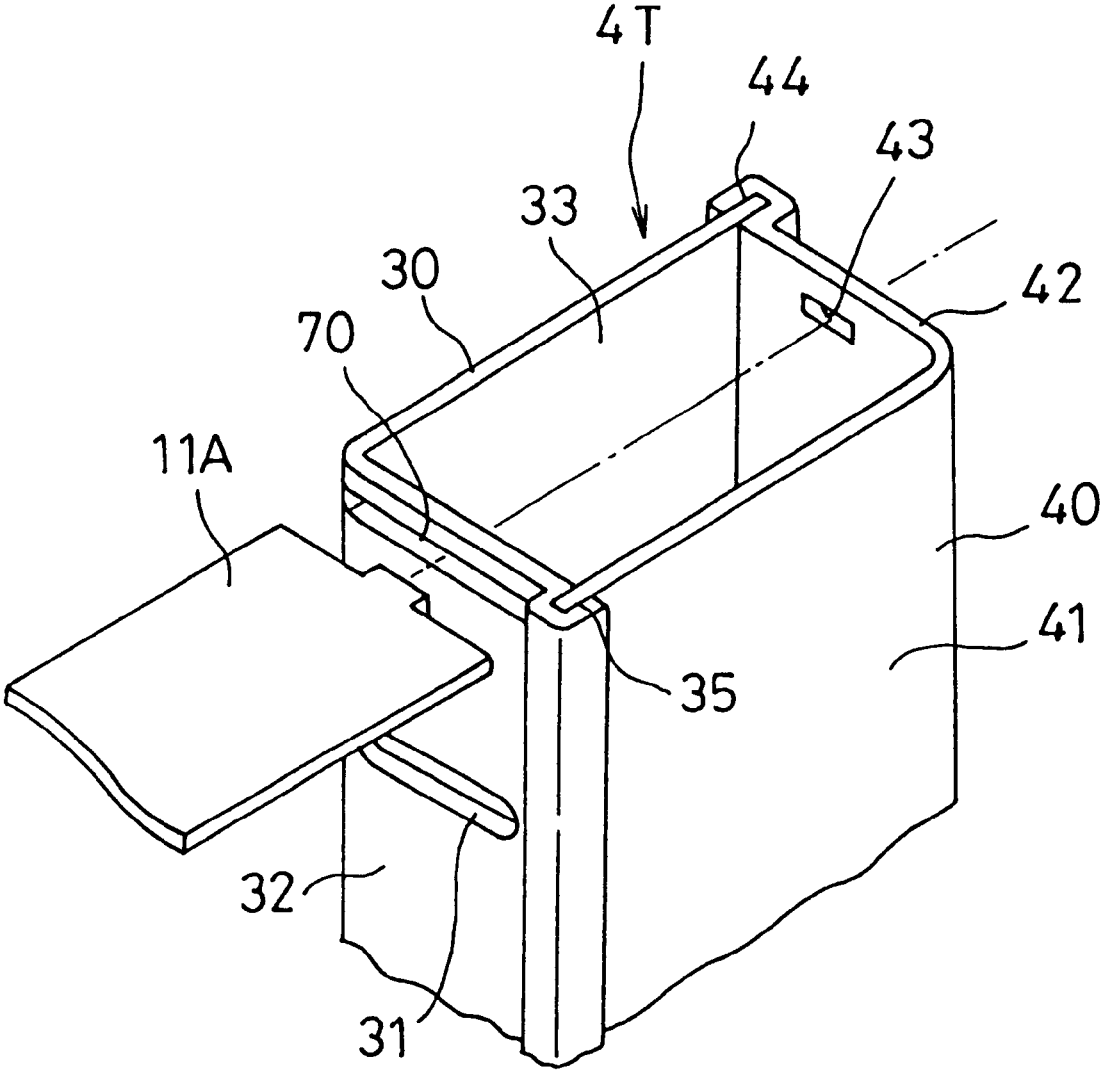
FIG. 15 is a perspective of the tank portion achieved in the twenty-first embodiment by forming the side plate and the blocking plate as an integrated unit and forming an insertion hole at the first L-shaped tank member.

In a tank portion 4T in the twenty-first embodiment shown in FIG. 15, an insertion hole 70 through which the side plate 11A formed to also function as the blocking plate is inserted is formed at a specific position near each of the two ends of the mounting wall 32 in the first L-shaped tank member 30 along the lengthwise direction. By forming the insertion hole 70 in this manner, it becomes possible to hold the side plate 22A from two directions to improve the mountability.

Figure 16:
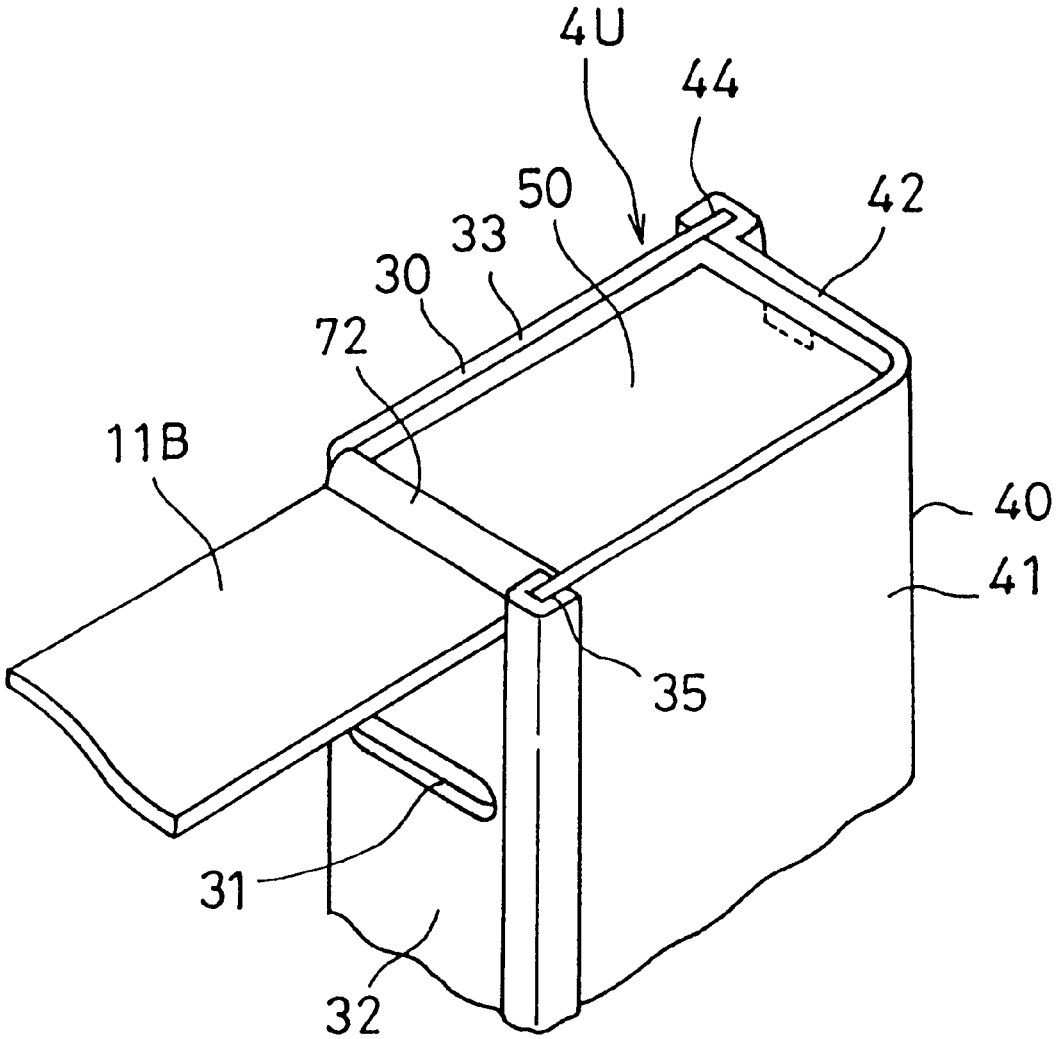
FIG. 16 is a perspective of the tank portion achieved in the twenty-second embodiment by forming the side plate and the blocking plate as an integrated unit via the bypass portion.

In the twenty-second embodiment shown in FIG. 16, a tank portion 4U is provided with a blocking plate 50 which is formed as an integrated part of a side plate 11B via an arched bypass portion 72. Since the side plate 11B and the blocking plate 50 can be formed as an integrated unit simply by machining the side plate 11B without having to perform any special machining on the first L-shaped tank member 30, the tank portion 4U can be formed with greater ease.

Figure 17:
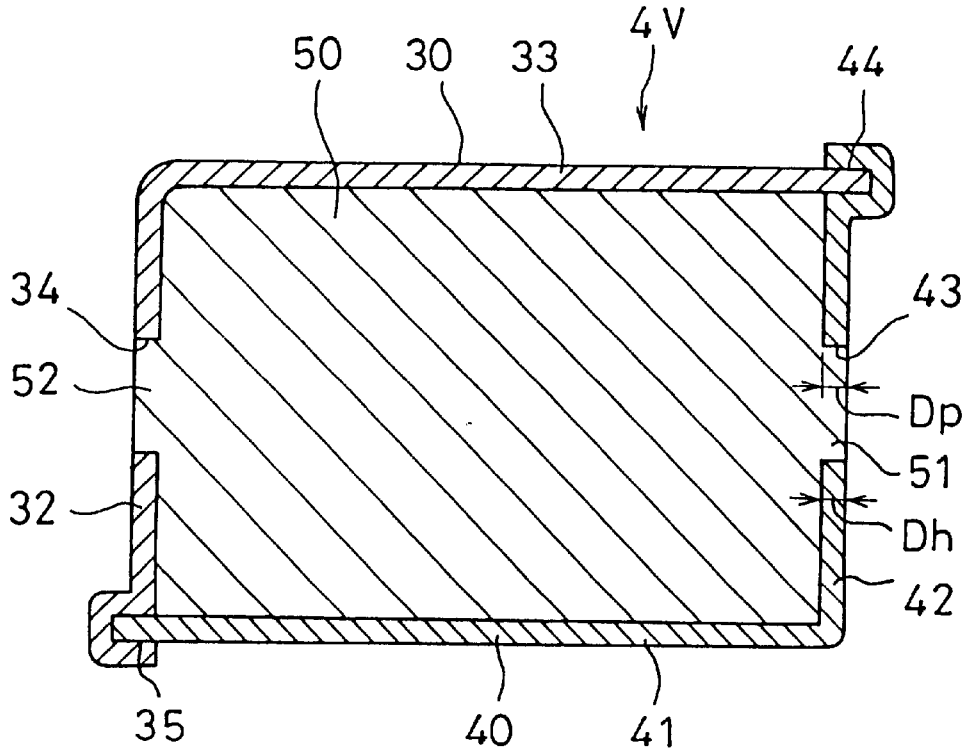
FIG. 17 is a sectional view of the tank portion achieved in the twenty-third embodiment, illustrating the blocking plate that blocks the opening defined by the first and second L-shaped tank members.
Figure 18:
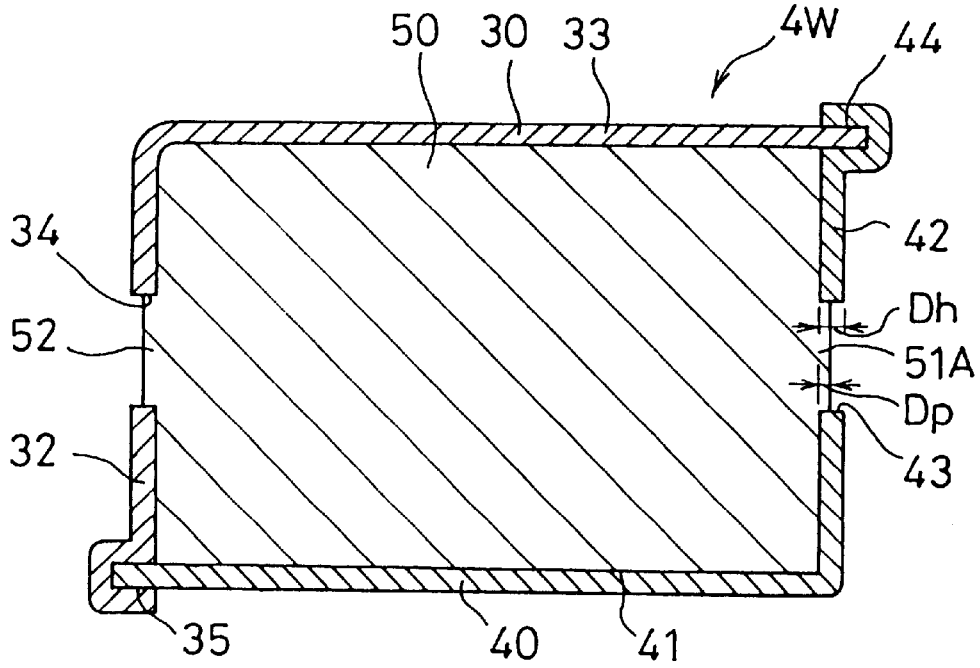
FIG. 18 is a sectional view of the tank portion achieved in the twenty-fourth embodiment having a blocking plate at which the distance over which the positioning projected portion projects out is set at a small value.
Figure 19:
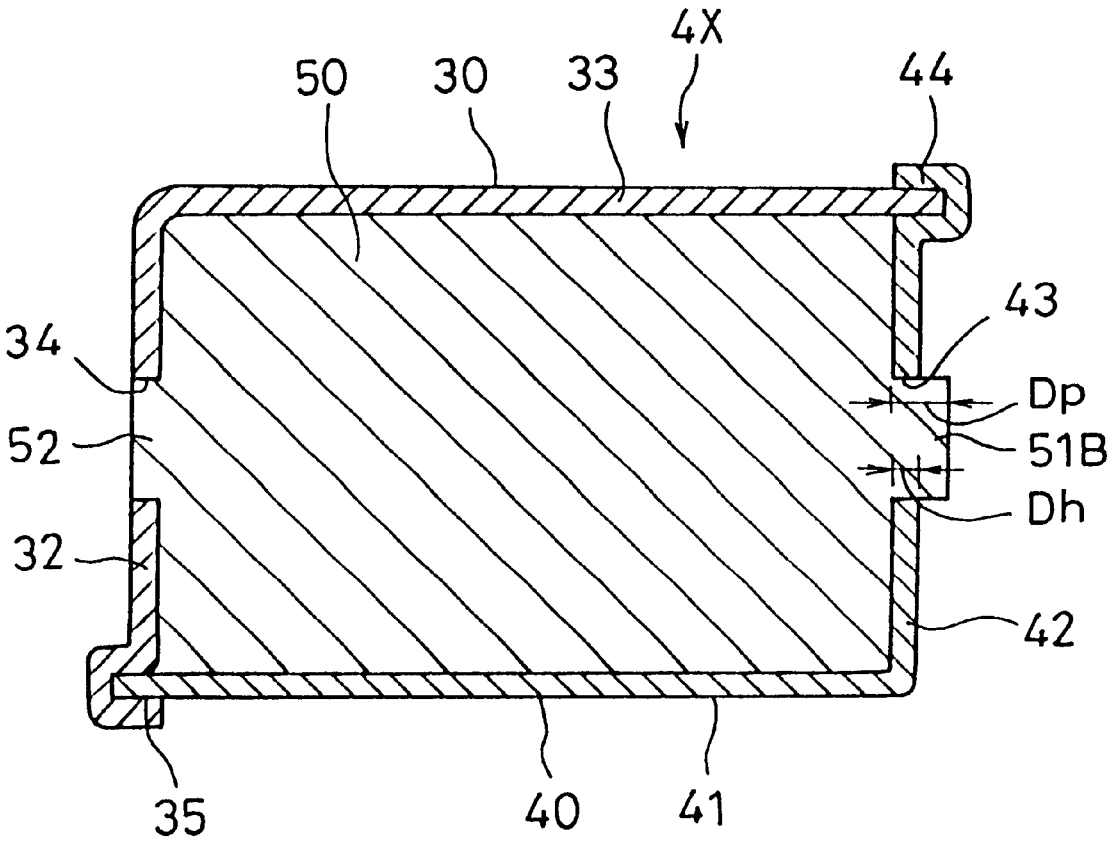
FIG. 19 is a sectional view of the tank portion achieved in the twenty-fifth embodiment having a blocking plate at which the distance over which the positioning projected portion projects out is set at a large value.

FIGS. 17 through 19 illustrate the relationship between the first and second projected portions 51 and 52 of the blocking plate 50 that closes off the opening at a tank portion 4V, 4W or 4X constituted of the first L-shaped tank member 30 and the second L-shaped tank member 40, and the fitting holes 34 and 43. In the twenty-third embodiment illustrated in FIG. 17, the distance DP over which the first and second projected portions 51 and 52 project out is set equal to the depth Dh (the thickness of the second L-shaped tank member 40) of the fitting holes 34 and 43. In addition, in the twenty-fourth embodiment illustrated in FIG. 18, the distance DP over which the first and second projected portions 51 A and 51 project out is set smaller than the depth Dh of the fitting holes 34 and 43 to ensure that the first projected portion 51A will never project out of the fitting hole 43. Thus, since the first projected portion 51A does not project out of the fitting hole 43 to come in contact with the tightening jig, defective tightening does not occur.

In contrast, in the twenty-fifth embodiment illustrated in FIG. 19, the distance DP over which a first projected portion 51 B at the blocking plate 50 projects out is set larger than the depth Dh of the fitting hole 43 at the tank portion 4X. This improves the mountability with the first projected portion 51B, and by pressing the portion that projects out further relative to the fitting hole 43, the force with which the blocking plate 50 is held is increased.

Figure 20:
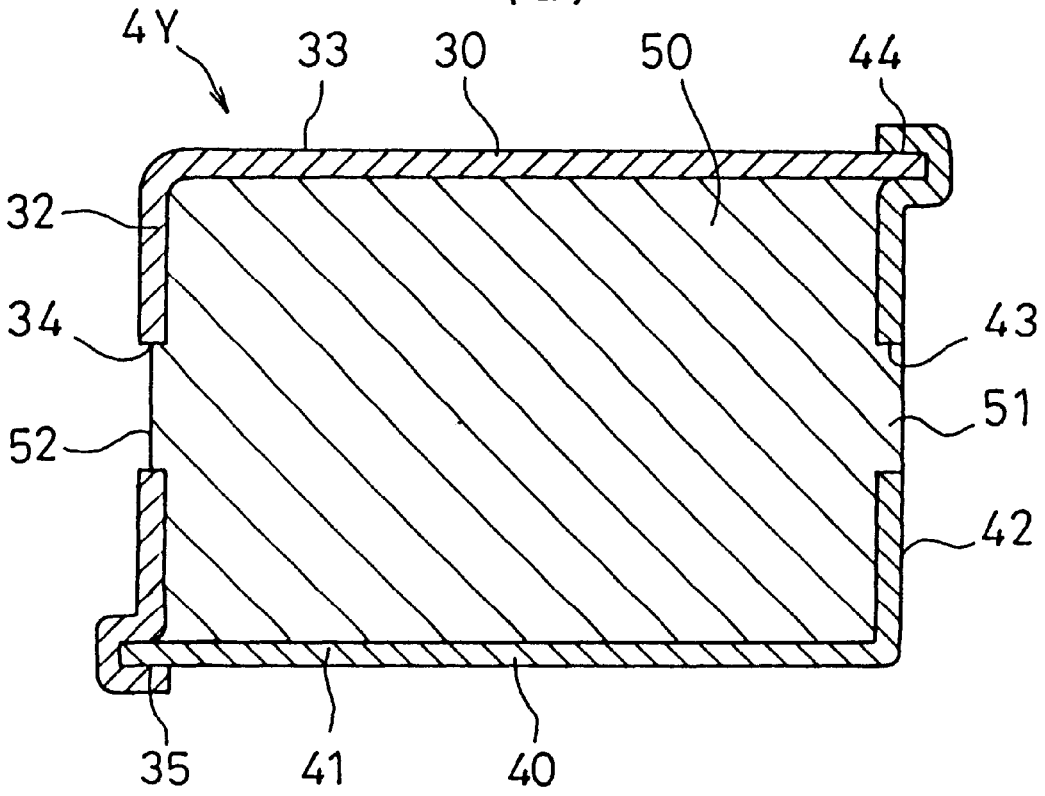
FIG. 20(*a*) is a sectional view of the tank portion in the twenty-sixth embodiment having its blocking plate formed along the internal circumferential side surfaces of the first and second L-shaped tank members and FIG. 20(*b*) is a plan view illustrating the shape of the blocking plate.
Figure 20:
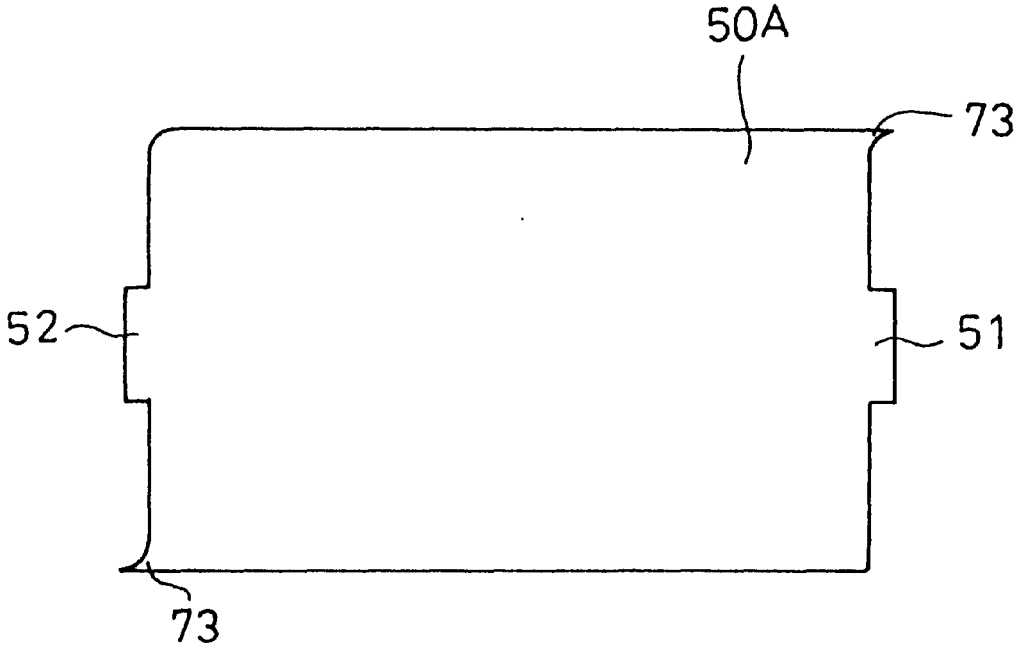

A blocking plate 50A of a tank portion 4Y in the twenty-sixth embodiment illustrated in FIGS. 20(*a*) and (*b*) is provided with projected portions 73 formed in advance in conformance to the shape of the corners. Thus, the blocking plate 50A is placed in complete contact with the opening of the tank portion 4Y to reduce the rate of occurrence of defective brazing.

The embodiments illustrated in FIGS. 21(a) and (*b*) are characterized in that a sacrificial corrosion layer 84 is formed at the surface located on the inside of the tank portion. Accordingly, the first L-shaped tank member 30, the second L-shaped tank member 40 and the plate used to form the blocking member constituting the tank portion all achieve a 2-layer or a 3-layer structure constituted of aluminum alloy.

Figure 21:
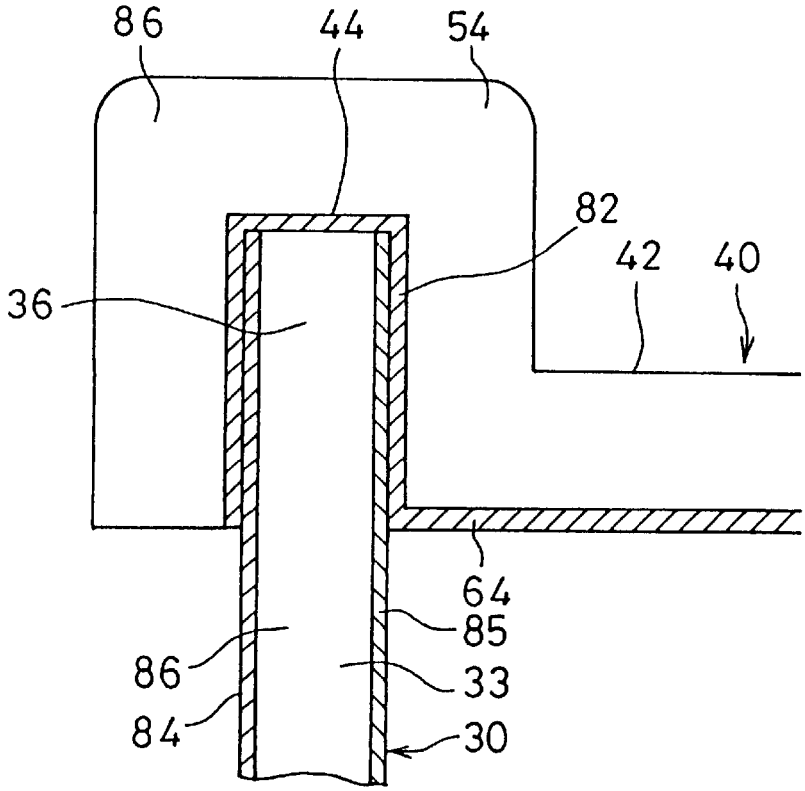
FIG. 21(*a*) is an enlargement of a portion of the bonded area at the tank portion constituted of a three-layer first L-shaped tank member and a two-layer second L-shaped tank member and FIG. 21(*b*) is an enlargement of a portion of the bonded area at the tank portion constituted of a two-layer first L-shaped tank member and a three-layer second L-shaped tank member.
Figure 21:
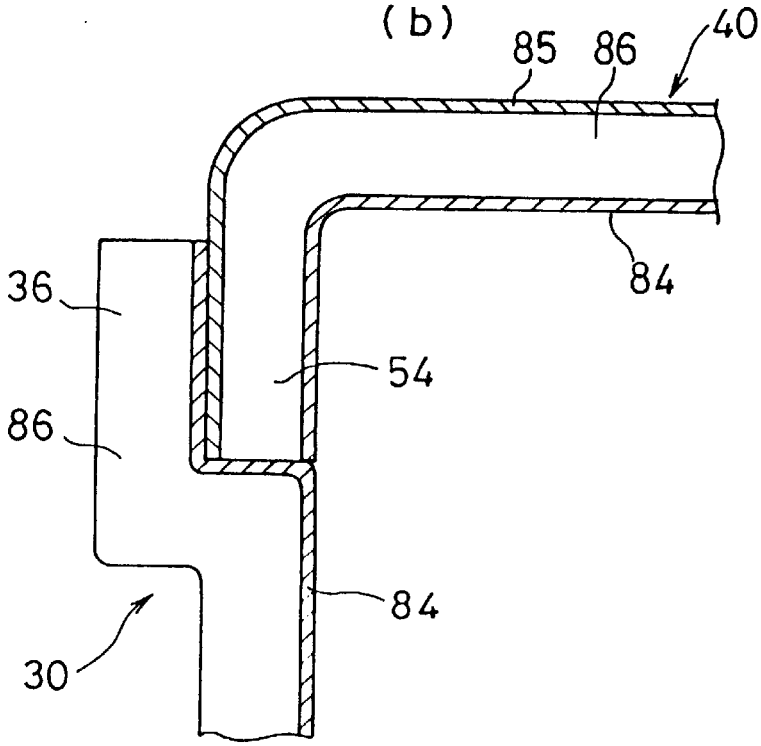

In the embodiment illustrated in FIG. 21(*a*), the second L-shaped tank member 40 achieves a 2-layer structure constituted of a core material 86 and a sacrificial corrosion layer 84 and the first L-shaped tank member 30 achieves a 3-layer structure constituted of a brazing material layer 85, a core material 86 and a sacrificial corrosion layer 84. In the embodiment illustrated in FIG. 21(*b*), the second L-shaped tank member 40 achieves a 3-layer structure constituted of a brazing material layer 85, a core material 86 and a sacrificial corrosion layer 84, and the first L-shaped tank member 30 achieves a 2-layer structure constituted of a core material 86 and a sacrificial corrosion layer 84.

Figure 22:
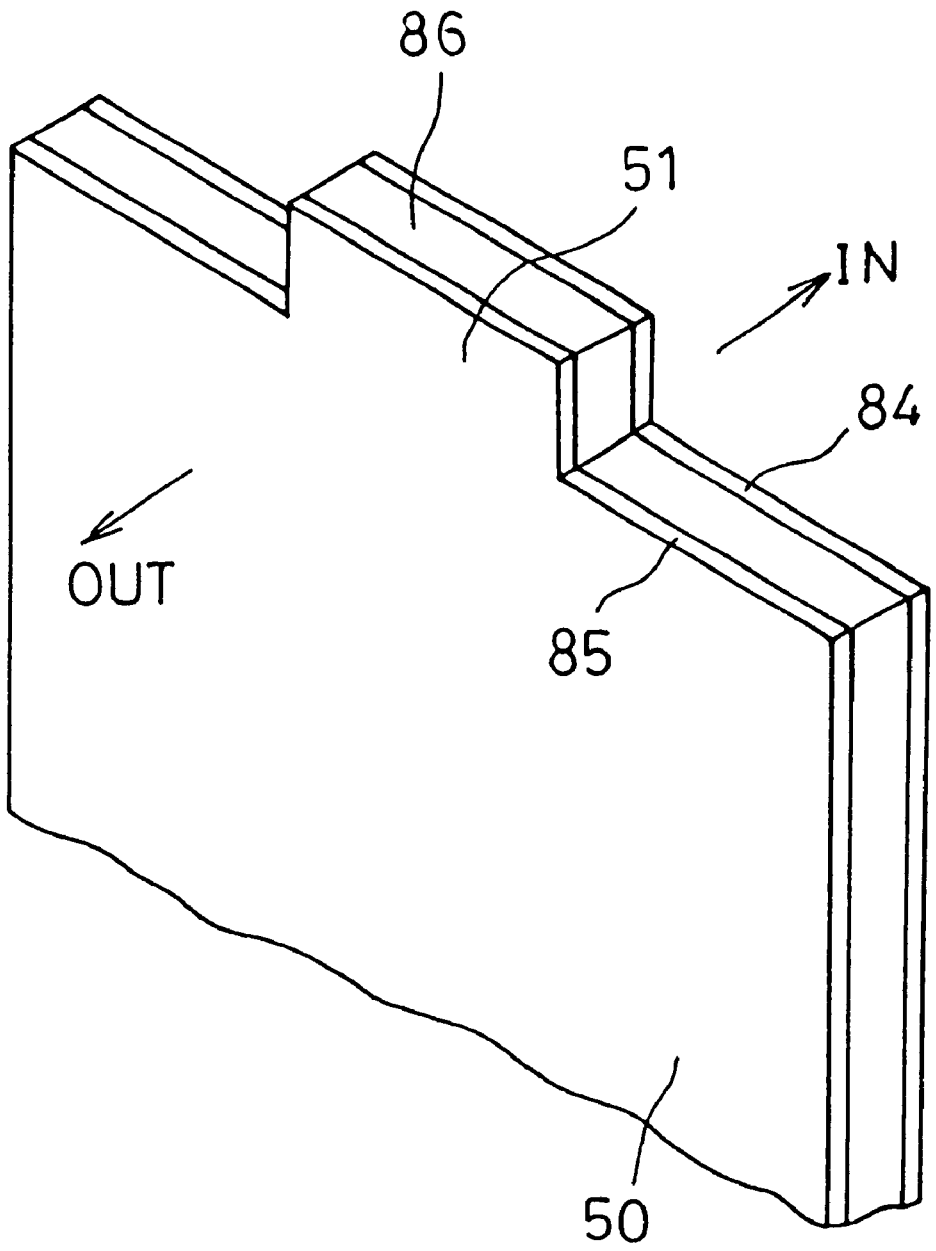
FIG. 22 is an enlarged perspective illustrating a portion of a three-layer blocking plate.
Figure 23:
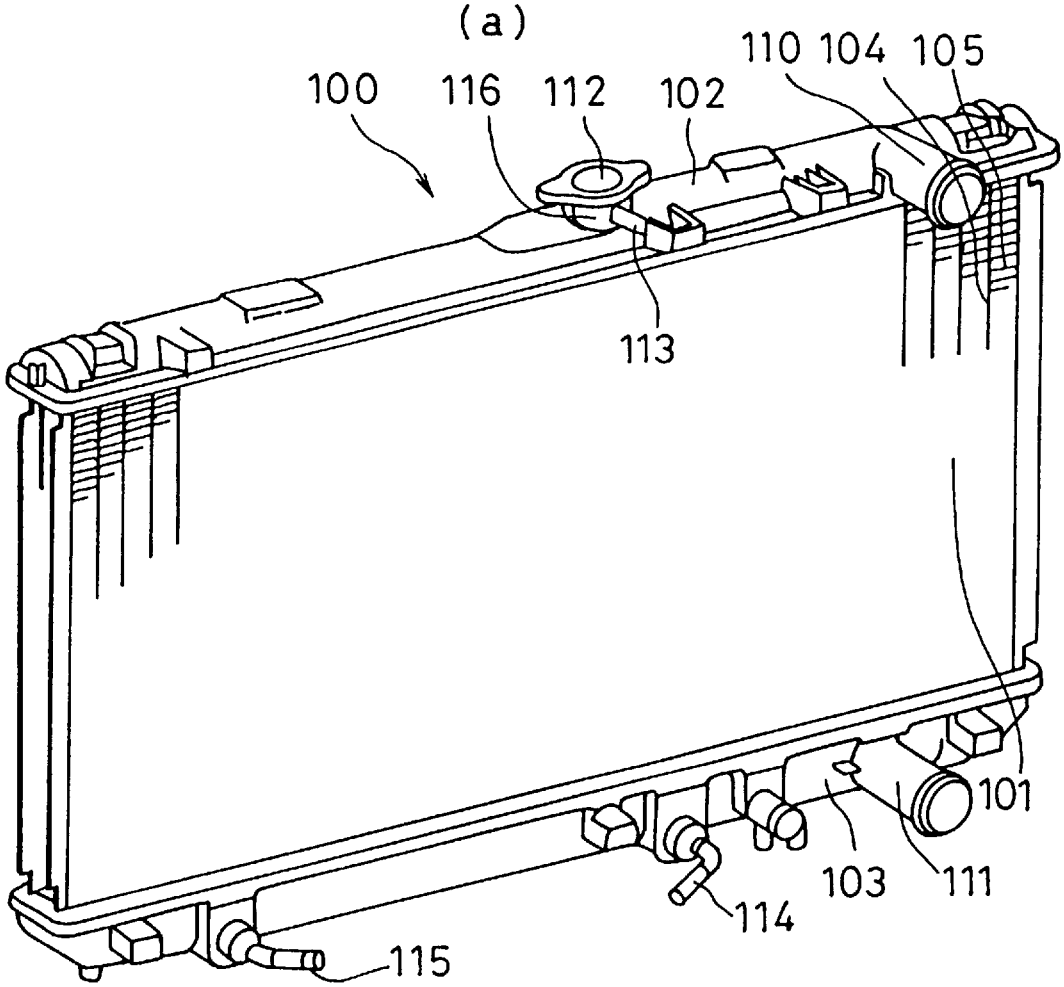
FIG. 23(*a*) is a perspective presenting an example of a radiator in the prior art and FIG. 23(*b*) is a sectional perspective in an enlargement of a portion of the same radiator.
Figure 23:
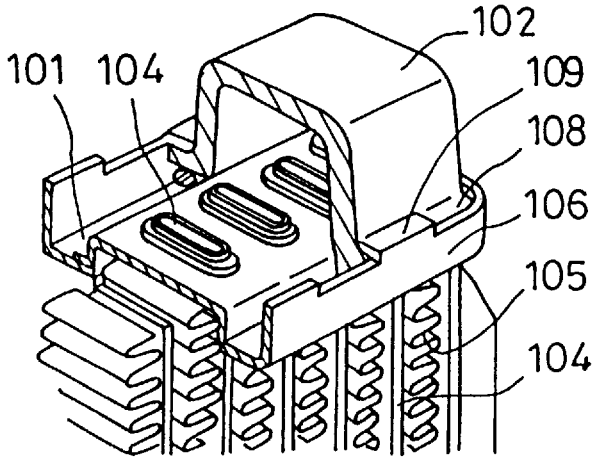

In addition, in the example illustrated in FIG. 22, the blocking plate 50, too, achieves a structure having a sacrificial corrosion layer 84 formed at its surface on the inside of the tank portion. In this embodiment, the blocking plate 50 achieves a 3-layer structure constituted of a brazing material 85, a core material 86 and a sacrificial corrosion layer 84.

In the embodiments of the present invention, the core material is constituted of a 3,000-type aluminum alloy, the brazing material is constituted of a 4,000-type aluminum alloy containing silicon and the sacrificial corrosion layer is constituted of a 7,000-type aluminum alloy or a 1,000-type aluminum alloy.

By providing the sacrificial corrosion layer 84 on the inside of the tank portion, the core material is prevented from becoming corroded since the sacrificial corrosion layer 84 becomes corroded ahead of the other aluminum alloys to form an oxide film.

Industrial Applicability

As explained above, according to the present invention, which enables integrated brazing to be implemented for the radiator, the assembly costs are reduced and, at the same time, the recyclability is improved.

Since the tank portion is constituted of the first and second L-shaped tank members, the A/T oil cooler only needs to be mounted at either of the L-shaped tank members prior to the assembly process to achieve ease of assembly for the tank and the A/T oil cooler.

In addition, since half of the brazed area at the member constituting the tank portion is distanced from the tubes and the fins, repair on areas with defective brazing is facilitated and, at the same time, the tubes or the fins do not become melted during the repair process implemented through torch brazing or the like.

Furthermore, since the members constituting the tank portion are simplified, a cost reduction is achieved with respect to the tank die.

Since calking tabs are provided at a member constituting the tank portion, i.e., either at the first L-shaped tank member or the second L-shaped tank member to be more specific, to secure the members through calking, the two parts do not become misaligned with respect to each other during the brazing process.

In addition, by forming projected and indented retaining portions at the bonding areas of the first L-shaped tank member and the second L-shaped tank member constituting the tank portion, the two members can be positioned and assembled with ease to prevent any misalignment from occurring during the brazing process. Furthermore, since positioning projected portions are formed at the blocking plate formed as a member that is independent of the first L-shaped tank member, and the fitting holes in which the projected portions fit are formed at the other member, the blocking plate can be positioned with a high degree of ease to improve the assemblability and to prevent defective brazing.

Moreover, since the distance by which the projected portion of the blocking plate located toward the second L-shaped tank member is set smaller than the depth of the fitting hole (the thickness of the plate), the projected portion is prevented from becoming projected out of the fitting hole to ensure that the projected portion does not come in contact with the tightening jig and that the three members constituting the tank portion are bonded with a high degree of reliability. In contrast, by setting the distance by which the projected portion projects out larger than the depth of the fitting hole, the projected portion is allowed to project out from the fitting hole, the blocking plate is secured to the second L-shaped tank member with the portion projecting out of the fitting hole either bent or pressed, to prevent the tightening jig from coming in contact with the projected portion, and reliable bonding of the three members constituting the tank portion is achieved.

Furthermore, by forming a sacrificial corrosion layer at the surface on the inside of the tank portion, the corrosion resistance of the tank portion is improved to achieve an improvement in the durability of the tank portion.

What is claimed is:

1. A heat exchanger provided with at least a tank portion, a plurality of tubes communicating with said tank portion and fins provided between said tubes, characterized in that said tank portion comprises:

a first L-shaped tank member constituted of a mounting wall at which said plurality of tubes are inserted and a first wall extending in the direction of which said tubes are mounted from an edge of said mounting wall along the direction of the length thereof;

a second L-shaped tank member constituted of a first wall bonded at an end of said mounting wall in said first L-shaped tank member and a second wall extending from an edge of said first wall along the direction of the length thereof so as to become bonded with said first wall of said first L-shaped tank member; and a blocking member provided at each of the two ends along the direction of the length of said first L-shaped tank member and said second L-shaped tank member; and at least said first L-shaped tank member, said second L-shaped tank member, said tubes and said fins are brazed as an integrated unit in a furnace.

2. A heat exchanger according to claim 1, characterized in that said first L-shaped tank member is provided with a fitting groove formed at one of said walls thereof along the direction of the length, and an end of one of said walls of said second L-shaped tank member is inserted at said fitting groove.

3. A heat exchanger according to claim 2, characterized in that retaining portions that connect with each other are formed at said fitting groove and said first wall of either said first L-shaped tank member or said second L-shaped tank member fitted inside said fitting groove, and preliminary assembly of said first L-shaped tank member and said second L-shaped tank member is achieved prior to brazing through retention achieved at said retaining portions.

4. A heat exchanger according to claim 3, characterized in that said retaining portions comprise a retaining projected portion and a retaining indented portion that is retained at said retaining projected portion.

5. A heat exchanger according to claim 2, characterized in that intake/outlet pipes through which heat exchanging medium flows are formed at said first wall of said first L-shaped tank member.

6. A heat exchanger according to claim 2, characterized in that said mounting wall of said first L-shaped tank member is formed as a flat plane and the cross section of said first L-shaped tank member achieves a rough L shape.

7. A heat exchanger according to claim 2, characterized in that said mounting wall of said first L-shaped tank member is formed as a projecting surface projecting out toward said tubes and the cross section of said first L-shaped tank member achieves an irregular J shape.

8. A heat exchanger according to claim 2, characterized in that a holding wall that comes in contact with the outer side of an end of said first wall of said second L-shaped tank member is formed along the lengthwise direction at an end of said mounting wall of said first L-shaped tank member.

9. A heat exchanger according to claim 2, characterized in that calking tabs are provided at a fitting groove at said first L-shaped tank member.

10. A heat exchanger according to claim 1, characterized in that said second L-shaped tank member is provided with a fitting groove at one of said walls thereof along the direction of the length, and an end of one of said walls of said first L-shaped tank member is inserted at said fitting groove.

11. A heat exchanger according to claim 10, characterized in that an oil cooler is mounted at said first wall of said second L-shaped tank member.

12. A heat exchanger according to claim 10, characterized in that a stage that comes in contact with said second wall of said second L-shaped tank member is formed along the lengthwise direction at an end of said first wall of said first L-shaped tank member.

13. A heat exchanger according to claim 10, characterized in that calking tabs are provided at a fitting groove at said second L-shaped tank member.

14. A heat exchanger according to claim 10, characterized in that retaining portions that connect with each other are formed at said fitting groove and said first wall of either said first L-shaped tank member or said second L-shaped tank member fitted inside said fitting groove, and preliminary assembly of said first L-shaped tank member and said second L-shaped tank member is achieved prior to brazing through retention achieve at said retaining portions.

15. A heat exchanger according to claim 1, characterized in that said first L-shaped tank member and said second L-shaped tank member are formed independently of said blocking member.

16. A heat exchanger according to claim 1, characterized in that said blocking member is formed as a plate having an external edge extending along internal circumferential side surfaces of said first L-shaped tank member and said second L-shaped tank member, is provided with a first positioning projected portion projecting out toward said mounting wall and a second positioning projected portion projecting out toward said second tank member, said first positioning projected portion is inserted in a first positioning hole formed at a specific position near an end of said mounting wall along the lengthwise direction in said first L-shaped tank member and said second positioning projected portion is inserted in a second positioning hole formed at a specific position near an end of said second L-shaped tank member along the lengthwise direction.

17. A heat exchanger according to claim 16, characterized in that the distance by which said second positioning projected portion projects out is set smaller than the thickness of said second L-shaped tank member.

18. A heat exchanger according to claim 16, characterized in that the distance by which said second positioning projected portion projects out is set larger than the thickness of said second L-shaped tank member.

19. A heat exchanger according to claim 1, characterized in that intake/outlet pipes through which heat exchanging medium flows are formed at said first wall of said first L-shaped tank member.

20. A heat exchanger according to claim 1, characterized in that an oil cooler is mounted at said first wall of said second L-shaped tank member.

21. A heat exchanger according to claim 1, characterized in that said mounting wall of said first L-shaped tank member is formed as a flat plane and the cross section of said first L-shaped tank member achieves a rough L shape.

22. A heat exchanger according to claim 1, characterized in that said mounting wall of said first L-shaped tank member is formed as a projecting surface projecting out toward said tubes and the cross section of said first L-shaped tank member achieves an irregular J shape.

23. A heat exchanger according to claim 1, characterized in that a stage that comes in contact with said second wall of said second L-shaped tank member is formed along the lengthwise direction at an end of said second wall of said second L-shaped tank member.

24. A heat exchanger according to claim 1, characterized in that a holding wall that comes in contact with the outer side of an end of said first wall of said second L-shaped tank member is formed along the lengthwise direction at an end of said mounting wall of said first L-shaped tank member.

25. A heat exchanger according to claim 1, characterized in that calking tabs are provided at a fitting groove at said first L-shaped tank member.

26. A heat exchanger according to claim 1, characterized in that calking tabs are provided at a fitting groove at said second L-shaped tank member.

27. A heat exchanger according to claim 1, characterized in that said blocking member is formed together with a side plate positioned at two ends in the direction in which said tubes and fins are laminated to achieve an integrated unit.

28. A heat exchanger according to claim 27, characterized in that a positioning projected portion projects out at an end of said blocking member formed together with said side plate as an integrated unit and said positioning projected portion is inserted in a positioning hole formed at said second wall of said second L-shaped tank member.

29. A heat exchanger according to claim 28, characterized in that a notched portion at which said side plate formed together with said blocking member as an integrated unit is mounted is formed at an end of said mounting wall of said first L-shaped member.

30. A heat exchanger according to claim 28, characterized in that said second wall of said second L-shaped tank member extends further along the lengthwise direction by a specific distance than said mounting wall of said first L-shaped tank member, and said positioning hole in which said positioning projected portion of said blocking member formed together with said side plate as an integrated unit is inserted is formed in said extended portion of said second L-shaped tank member.

31. A heat exchanger according to claim 28, characterized in that an insertion hole through which said blocking member formed together with said side plate as an integrated unit is inserted is formed near an end of said mounting wall of said first L-shaped tank member.

32. A heat exchanger according to claim 28, characterized in that said side plate formed together with said blocking member as an integrated unit is provided with an arched bypass portion that bypasses an end of said mounting wall along the lengthwise direction in aid first L-shaped tank member.

33. A heat exchanger according to claim 27, characterized in that a notched portion at which said side plate formed together with said blocking member as an integrated unit is mounted is formed at an end of said mounting wall of said first L-shaped tank member.

34. A heat exchanger according to claim 27, characterized in that said second wall of said second L-shaped tank member extends further along the lengthwise direction by a specific distance than said mounting wall of said first L-shaped tank member, and said positioning hole in which said positioning projected portion of said blocking member formed together with said side plate as an integrated unit is inserted is formed in said extended portion of said second L-shaped tank member.

35. A heat exchanger according to claim 27, characterized in that an insertion hole through which said blocking member formed together with said side plate as an integrated unit is inserted is formed near an end of said mounting wall of said first L-shaped tank member.

36. A heat exchanger according to claim 27, characterized in that said side plate formed together with said blocking member as an integrated unit is provided with an arched bypass portion that bypasses an end of said mounting wall along the lengthwise direction in said first L-shaped tank member.

37. A heat exchanger according claim 1 characterized in that a sacrificial corrosion layer is provided at surfaces of said first L-shaped tank member, said second L-shaped tank member and said blocking member constituting said tank portion on the inside of said tank portion and a brazing material layer is provided on the outside of said tank portion.

38. A heat exchanger according to claim 37, characterized in that said sacrificial corrosion layer is constituted of an aluminum alloy containing zinc.

39. A heat exchanger according to claim 38, characterized in that said brazing material layer is constituted of an aluminum alloy containing silicon.

40. A heat exchanger according to claim 37, characterized in that said brazing material layer is constituted of an aluminum alloy containing silicon.

* * * * *